US010196822B2

(12) United States Patent
Deutsch

(10) Patent No.: US 10,196,822 B2
(45) Date of Patent: Feb. 5, 2019

(54) SKYLIGHT WITH MANUAL CLOSING FEATURE

(71) Applicant: Nachman Deutsch, Monsey, NY (US)

(72) Inventor: Nachman Deutsch, Monsey, NY (US)

( * ) Notice: Subject to any disclaimer, the term of this patent is extended or adjusted under 35 U.S.C. 154(b) by 0 days.

(21) Appl. No.: 14/704,142

(22) Filed: May 5, 2015

(65) Prior Publication Data

US 2015/0315793 A1 Nov. 5, 2015

Related U.S. Application Data

(60) Provisional application No. 61/988,780, filed on May 5, 2014.

(51) Int. Cl.

| | |
|---|---|
| ***E04D 13/035*** | (2006.01) |
| ***E05F 15/00*** | (2015.01) |
| ***B65H 75/44*** | (2006.01) |
| ***E05F 11/04*** | (2006.01) |
| ***E05F 1/10*** | (2006.01) |

(52) U.S. Cl.

CPC ..... *E04D 13/0354* (2013.01); *B65H 75/44* (2013.01); *E05F 1/1091* (2013.01); *E05F 11/04* (2013.01); *E05F 15/00* (2013.01); *E05Y 2900/152* (2013.01)

(58) Field of Classification Search

CPC ..... E04D 13/0354; E04D 13/0357; E05F 1/1091; E05F 11/04; B65H 75/4418; B65H 75/4423; B65H 75/4428; B65H 75/4431; B65H 2403/72; B65H 2403/731

See application file for complete search history.

(56) References Cited

U.S. PATENT DOCUMENTS

| | | | | | |
|---|---|---|---|---|---|
| 383,920 | A | * | 6/1888 | Steele | E05F 11/04 49/328 |
| 1,830,405 | A | * | 11/1931 | Tadashi Ohno | E06B 9/74 160/300 |
| 2,424,910 | A | * | 7/1947 | Benson | B66D 1/06 182/113 |
| 2,624,547 | A | * | 1/1953 | Walz | B66D 1/04 254/357 |
| 3,391,907 | A | * | 7/1968 | Vogelsang | B63B 21/16 114/102.2 |
| 4,164,106 | A | | 8/1979 | Klosz | |

(Continued)

FOREIGN PATENT DOCUMENTS

| | | | |
|---|---|---|---|
| EP | 0 320 407 | * | 6/1989 |
| FR | 2 678 308 | * | 12/1992 |

*Primary Examiner* — Gregory J Strimbu
(74) *Attorney, Agent, or Firm* — Amster, Rothstein & Ebenstein LLP

(57) ABSTRACT

A skylight or roof hatch that is manually opened and closed. The skylight is formed of a window mounted to a casing frame by way of one or more hinges which allows the window to open and close. One more gas springs mounted between the window and the casing frame are configured to exert a force against the inside of the window. The gas springs are used to urge the window into an open position. Once in the open position, the window is closed by overcoming the force exerted by the gas springs. This is achieved by winding in a cable that is connected to the window. A single pulley wheel is part of a control unit which is utilized to spool in the cable connected to the window in order to close the window and to unlock a reel lock to allow for automatic opening of the window.

19 Claims, 16 Drawing Sheets

(56) References Cited

U.S. PATENT DOCUMENTS

| | | | | |
|---|---|---|---|---|
| 4,195,819 | A * | 4/1980 | Chastanier | A62C 2/242 49/141 |
| 4,580,463 | A * | 4/1986 | Allouche | A62C 2/247 160/310 |
| 4,845,905 | A * | 7/1989 | Frank | E04D 13/0354 292/278 |
| 5,271,182 | A | 12/1993 | Greisner | |
| 5,344,121 | A * | 9/1994 | Baziuk | B66D 3/14 254/358 |
| 5,638,645 | A | 6/1997 | Lipton | |
| 5,871,069 | A * | 2/1999 | Carmitchel | B66F 9/08 187/231 |
| 6,446,391 | B1 | 9/2002 | Timothy | |
| 2004/0043722 | A1* | 3/2004 | Richter | E04D 13/0354 454/358 |
| 2008/0023903 | A1* | 1/2008 | Liu | B65H 5/06 271/10.13 |
| 2012/0036783 | A1* | 2/2012 | Ryberg | E04D 13/0354 49/358 |
| 2013/0119598 | A1* | 5/2013 | Kuo | B65H 9/006 271/10.11 |

* cited by examiner

SKYLIGHT WITH MANUAL CLOSING FEATURE

RELATED APPLICATIONS

This application claims the benefit of U.S. Prov. Appl. Ser. No. 61/988,780, filed on May 5, 2014, the contents of which are hereby incorporated by reference herein.

FIELD OF THE INVENTION

The current invention relates to the field of skylights and roof hatches, more specifically to a skylight that allows for controlled incremental manual opening and closing.

BACKGROUND OF THE INVENTION

Skylights are becoming increasingly popular in homes and businesses. Some skylights are large and heavy and, as a result, they cannot be opened and closed using manual strength. Mechanical assistance is required to open and close these heavy skylights. To that end, many such skylights are operated by hydraulics or air/gas pressure. For example, skylights may be powered by an air compressor which pumps air to move an arm in order to open the skylight and it releases air to lower the arm.

One problem with prior systems of opening and closing such skylights is that they require electric power. Thus, if there is a blackout or shortage in electrical power supply—the skylights cannot be operated. This can be especially troublesome in the event that a large skylight is open and then power is lost—potentially putting a homeowner at risk of his/her house becoming flooded by rain or snow. Moreover, in order to operate skylights with hydraulics or air compression—hoses must be run from a compressor unit to the skylight. It requires extensive work to run hoses from a compressor that is usually housed in a basement to the skylight unit. Such efforts are even more difficult when attempting to retrofit an existing structure with a skylight, and the hoses and switches must be buried inside existing finished wall surfaces. Still further, a homeowner or business owner may want to install a skylight in an area that is outside the range of an electric power source.

The invention described herein addresses the need for a large-sized skylight or roof hatch that is operated by manually controlled mechanical elements without the need of electricity.

SUMMARY OF THE INVENTION

The skylight described herein has attached gas springs that are used to open the window. The gas springs bias the window toward an open position, such that when the biasing force becomes unopposed by a counter force—the window is forced open. A cable that is wound around a cable reel provides opposing force to keep the window closed.

Once the window is open, the cable reel is turned several rotations to wind the cable and incrementally close the window. Winding the cable around the reel overcomes the biasing force created by the gas springs and doing so closes the window.

A chain attached to a pulley wheel is used to open and close the window through associated mechanical linkages. When the pulley wheel is rotated in one direction, associated mechanical linkages release the cable reel allowing for the window to open. When the pulley wheel is rotated in the opposite direction, the connected cable reel is turned to wind the cable around the cable reel and thereby force the window closed.

DETAILED DESCRIPTION OF THE INVENTION

Figure 1:
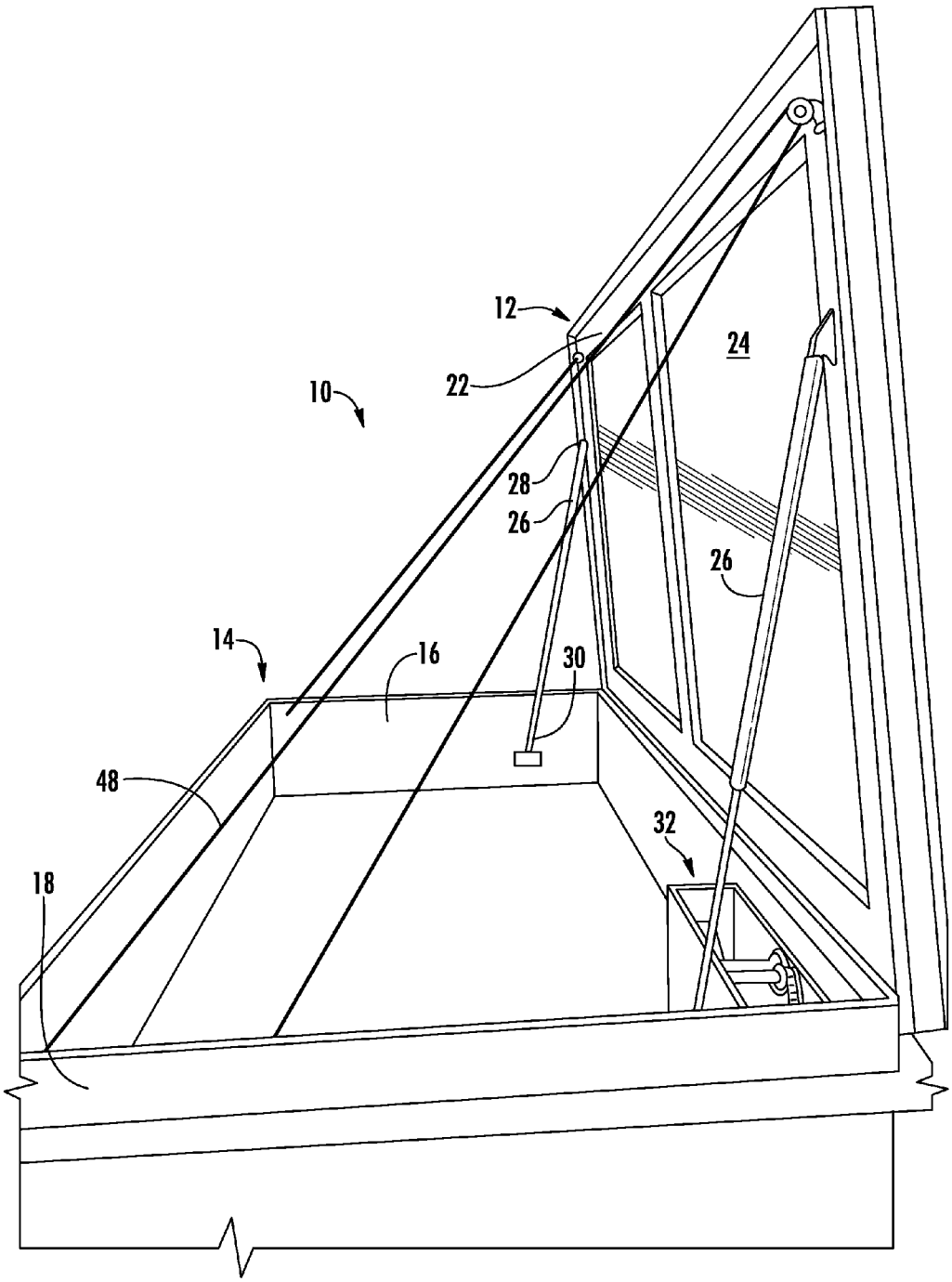
FIG. 1 is a side perspective view of a skylight opened at a right angle according to an embodiment of the invention.

The following is a detailed description of the preferred embodiments of the invention, reference being made to the drawings in which the same reference numerals identify the same elements of structure in each of the several figures. It should be noted that these drawings are merely exemplary in nature and in no way serve to limit the scope of the invention.

FIG. 1 shows a side, perspective view of a skylight unit 10. The unit is shown positioned in the orientation it would assume when installed in a roof—where a window 12 opens away from a casing frame 14 and upwardly with respect to the roof. As shown, the skylight unit 10 has a substantially rectangular casing frame 14. The casing frame is made of panels or boards which have an inside surface 16 and an outside surface 18. For purposes of installation, outside surfaces 18 of the frame are brought into close proximity with a joist or similar support structure in the roof and screws are driven through the inside surface 16 of the frame 14 penetrating the same and joining the casing frame 14 to joists—thereby forming part of the roof structure.

A window 12 is attached via hinges to the casing frame 14. The window 12 is comprised of a structural frame or sash 22 and a glass pane 24 mounted within the frame 22 (the window frame/sash 22 and the glass pane 24 are collectively referred to as the "window" herein). At least two gas springs 26 are attached for applying a constant open biasing force to the inside of window 12. As shown, a first end 28 of the gas spring is pivotably attached to the window frame and a second end 30 of the gas spring is pivotably attached to the inner surface 16 of the casing frame 14. The maximum angle at which the window opens is determined by the length and angle of the gas springs.

It will be understood by those of ordinary skill in the art that any of various force exerting arms may be used in place of or in combination with gas springs. For example, pneumatic, hydraulic or any such similar force exerting mechanisms that apply constant force such that the window is biased to open are all within the teaching of the invention. Moreover, it will be understood that the invention herein is not limited to a window and any of various roof hatches, awnings, hurricane shutters, garage doors or similar hinged or tracked panels or objects are within the teaching of the invention. The term "window" herein refers to any such hinged/tracked panel or object.

In one embodiment of the invention, and as shown in FIG. 1, the window opens to substantially 90°. When opening the window to a 90° angle, the window becomes locked in place when the gas springs 26 are fully extended. That is, in one direction (opening direction) the window cannot move past the limit of the gas springs 26 and in the reverse direction (closing direction) the window cannot overcome the biasing force of the gas springs 26—which maintains the window in an open position. The only way to close the window is to apply a force in the closing direction that is strong enough to overcome the opposing force exerted by the gas springs 26.

Figure 1A:
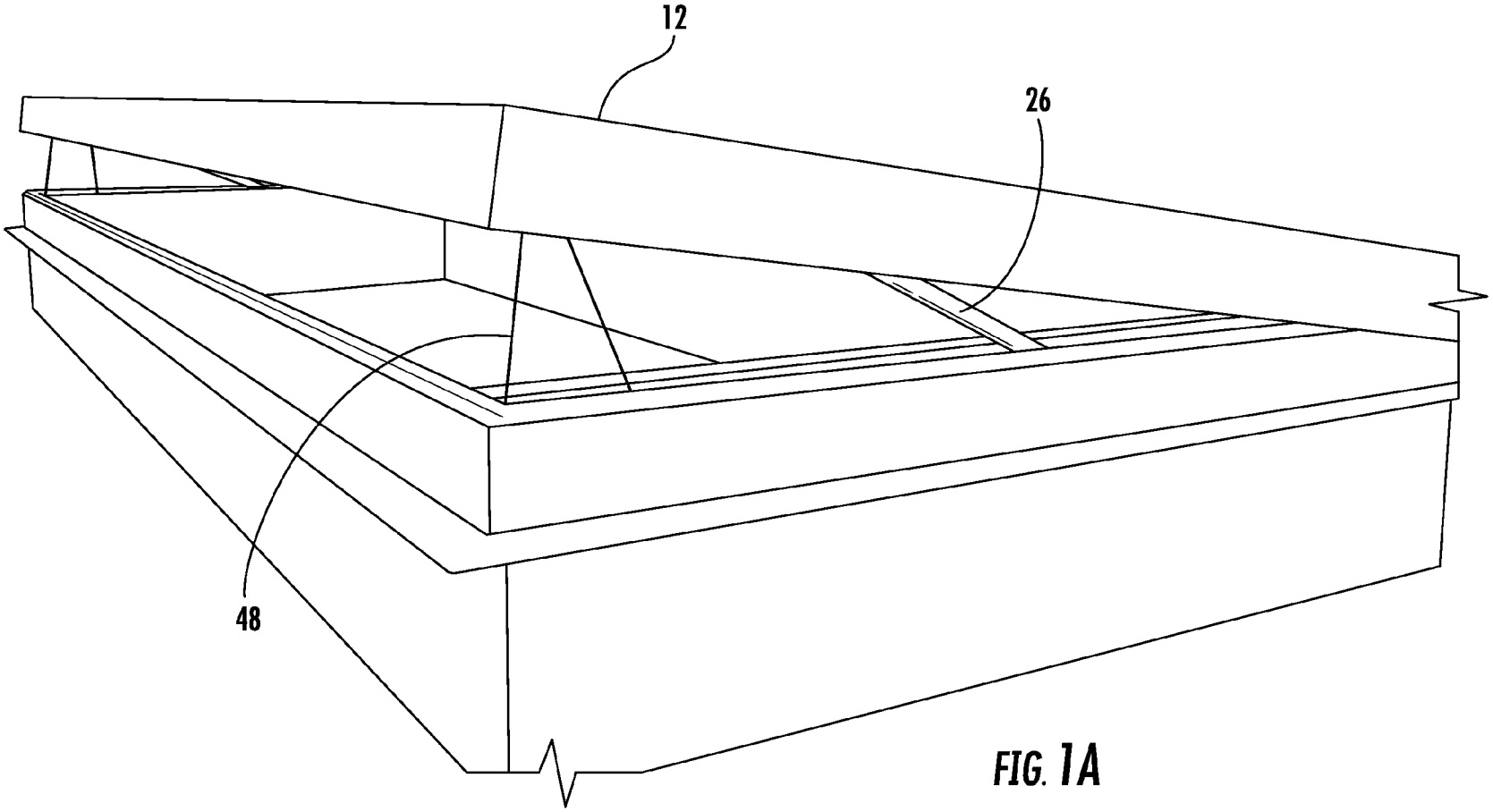
FIG. 1A is a side perspective view of a skylight in the process of being closed according to an embodiment of the invention.

A manual control unit 32 is mounted to the inside of the casing frame 14, which houses the mechanical components that are used to open and close the window. Manual control unit 32 is shown in secured to the lower right-corner of casing frame 14 in FIG. 1. Manual control unit 32 houses the mechanical parts to control the opening and closing of the window 12. A cable 48 which emanates from a cable reel 44 positioned in the control unit, is strung along the inner casing and contacts the inner window frame 22 at each longitudinal end thereof (through a series of pulley wheels not shown). When the cable reel is rotated, the cable winds around the drum thereof, generating a pulling or closing force on the window. Continued rotation of the cable reel causes incremental closing of the window. Because of the constant force applied to the window, when rotation of the cable reel is stopped, the window will remain in place at any point along its 90° range of movement. FIG. 1A shows a window in the process of closing. As shown, gas springs 26 support the window in place. Continued rotation of the cable reel will continue to draw the window down and ultimately close it completely.

Figure 2:
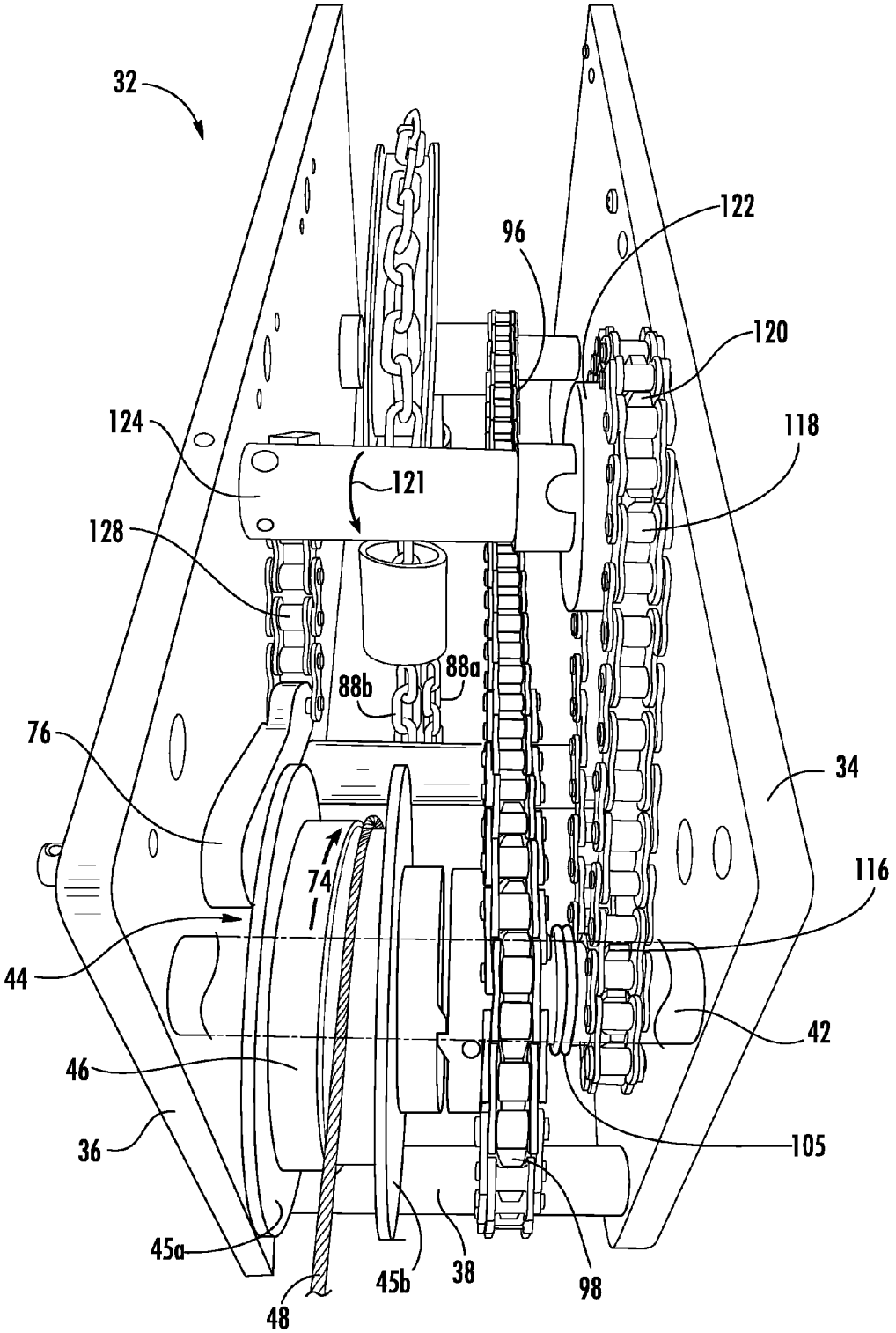
FIG. 2 is a top perspective view of a skylight manual control unit according to an embodiment of the invention.

FIG. 2 shows a top perspective view of the control unit 32. The control unit 32 shown in substantially the same orientation as it is positioned in FIG. 1. Control unit 32 has two substantially parallel plates—a right plate 34 and a left plate 36 that are joined to together by supporting cross bars. For example, cross bar 38, fits into corresponding holes in respective parallel plates 34, 36 and is fastened therein.

A cable reel 44 is mounted onto the shaft of an axle 42 secured between the parallel plates 34, 36. The cable reel 44 has a right face plate 45*b* a left face plate 45*a* (each face plate having an inner and outer surface) and a spooling drum 46 disposed between respective inner surfaces of face plates 45*a*, 45*b*. Cable reel 44 is rotatable to wind cable 48 about the axis of spooling drum 46, which then pulls the window downward through a series of pulley wheels that attach cable 48 to the window 12. Force exerted by the cable reel 44 on the cable 48 by rotation thereof overcomes the force exerted by gas springs 26—thereby closing the window when desired by a user.

Figure 3:
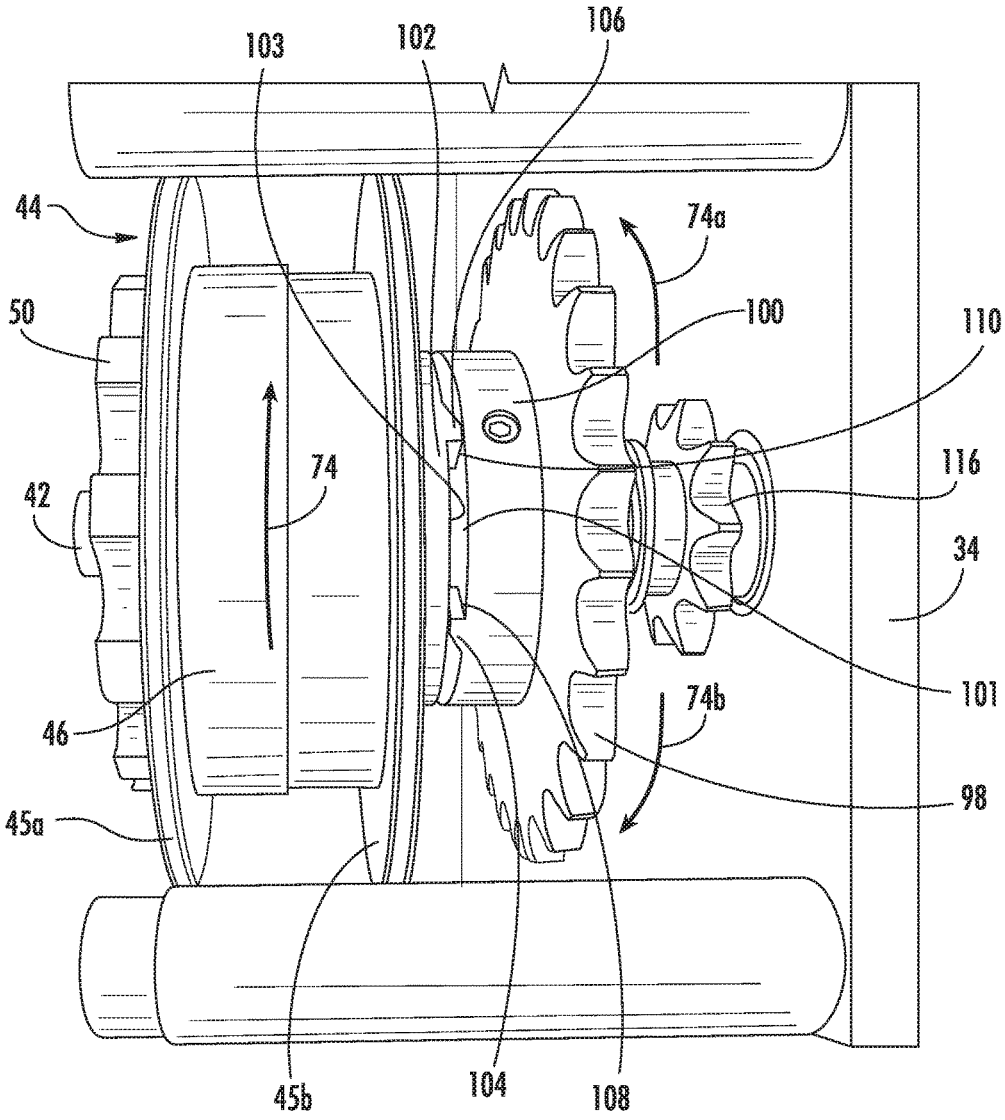
FIG. 3 is an enlarged front view of a cable reel, sprocket wheels and other mechanical components mounted on an axle according to an embodiment of the invention.

FIG. 3 shows an enlarged front view of the cable reel 44 and other mechanical components that are mounted about the axis of axle 42. Axle 42 is shown protruding from the left side of cable reel 44. Several novel mechanical parts in accordance with the invention are mounted along the axis of the axle 42, which will be explained below.

When the window is in a closed position a sufficient length of cable 48 is wound around cable reel 44 so as to maintain pulling force against the window in order to keep the window aligned with frame 14. In such position, the cable 48 counteracts the opposing force of the gas springs 26, and it maintains the window in a closed position. A reel lock system is utilized to lock the cable reel 44 in place with the cable 48 wound around the drum 46 so as to prevent unintended unspooling and thereby unwanted opening of the window.

Figure 4:
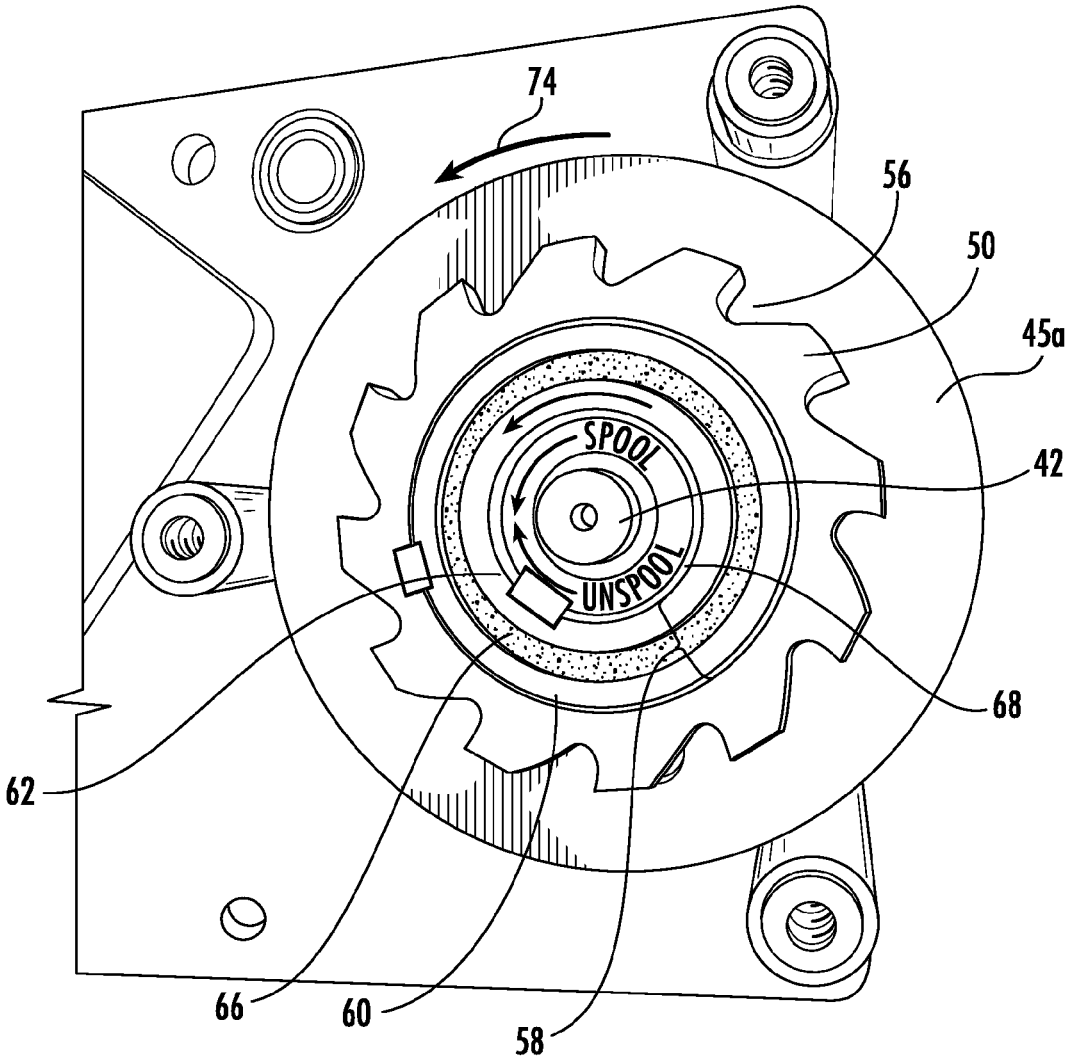
FIG. 4 is a side view of a cable reel mounted on an axle according to an embodiment of the invention.

FIG. 4 is a left side view of the cable reel 44 showing some of the novel elements that make up the reel locking system. As shown, a grooved wheel 50 is mounted to the outside surface of left face plate 45*a* of cable reel 44. Grooved wheel 50 communicates with the cable reel through a series of specialized rings.

Figure 5:
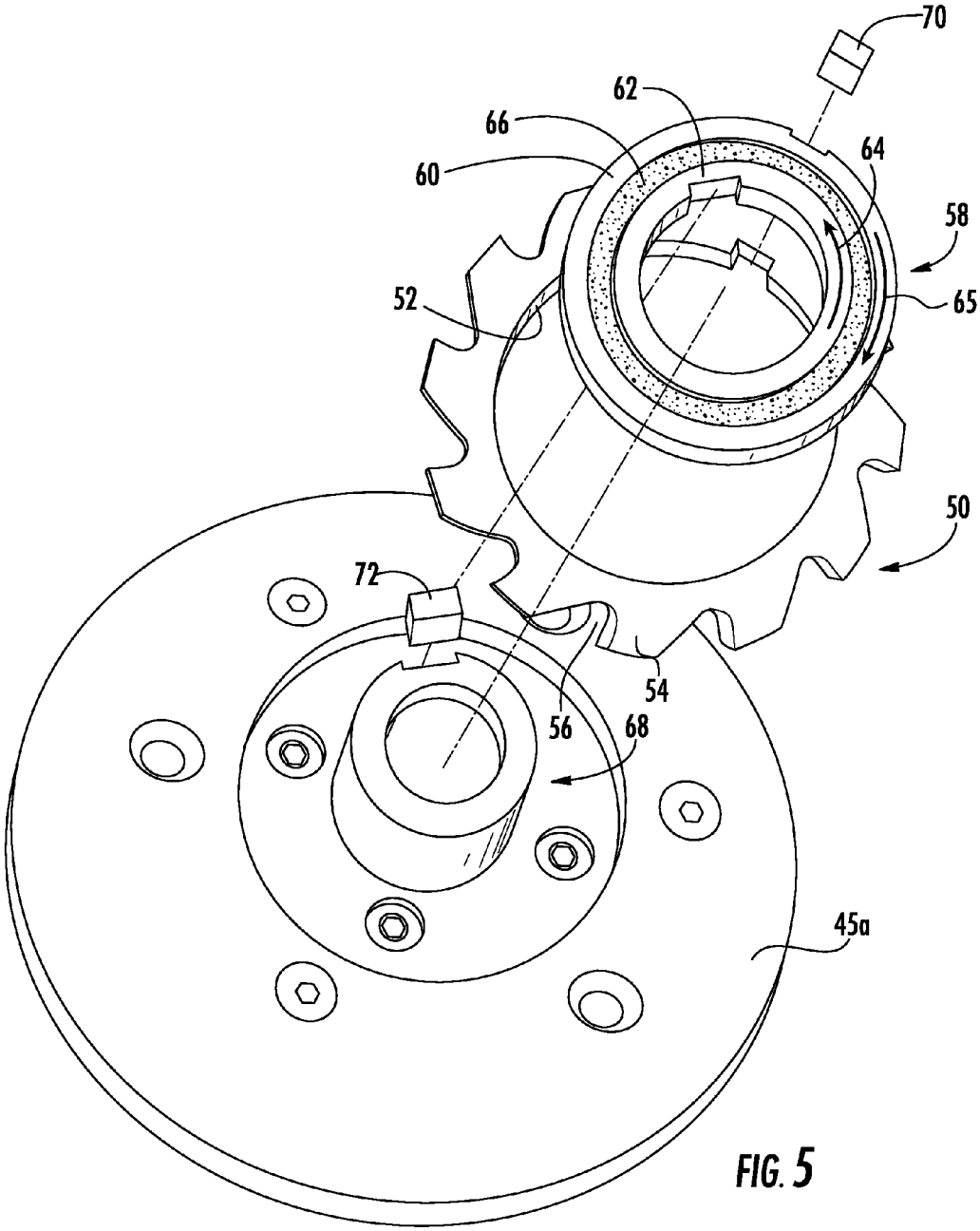
FIG. 5 is an exploded side perspective view of a left side plate of a cable reel and associated attachment rings according to an embodiment of the invention.

FIG. 5 is an exploded view of the specialized rings. Grooved wheel 50, the outer most ring, has an annular internal circumference 52 and a jagged external circumference. The external circumference is formed of alternating jagged projections or teeth 54 which create pockets or grooves 56 between respective teeth 54. Grooved wheel 50 surrounds an intermediate ring 58. Intermediate ring 58 is a clutch bearing that is composed of two separate rings that each rotates in a single direction with respect to the other. As shown, intermediate ring 58 is a unitary ring that has three regions—an outer ring 60, an inner ring 62 and a middle annular region 66 between the inner and outer rings. Middle region 66 contains a one-way movement mechanism. As shown, inner ring 62 of intermediate ring 58 moves in the direction of arrow 64 (e.g. counterclockwise), but it cannot move in the opposite direction because of a ratchet gear or similar one-way track that is disposed between outer ring 60 and inner ring 62 (depicted as "66"). Outer ring 60 rotates in a clockwise direction (i.e. in the direction of arrow 65—which is opposite to the rotational direction of inner ring 64), but it cannot rotate in the opposite direction. As such, if outer ring 60 were locked in place then outer ring 60 will not be able to rotate at all and only inner ring 62 would be allowed to rotate—and, importantly, in a single direction (i.e. in the direction of arrow 64).

Intermediate ring 58 surrounds a hub bushing 68. Hub bushing 68 is a ring or similar bushing that is connected to or integrally formed with side face plate 45*a* of cable reel 44. Because hub bushing 68 is attached to cable reel 44—a barrier or brake that secures hub bushing 68 in place would prevent the cable reel from rotating, whereas, removing the brake would allow the cable reel 44 to freely rotate.

Grooved wheel 50 is attached to intermediate ring 58, for example, by way of a connection block or key 70. Intermediate ring 58 is attached to hub bushing 68, for example, by way of key 72. Hub bushing 68 is affixed to the side face plate 45*a* of cable reel 44 and axle 42 runs through the interior circumference thereof. Rotation of bushing hub 68 correspondingly rotates the attached cable reel 44—and vice versa.

In operation, cable reel 44 is rotated in a counterclockwise manner (i.e. in the direction of arrow 74 shown in FIGS. 2, 3 and 4—to the left in the orientation shown in FIG. 4) in order to wind the cable 48 around the spooling drum 46 of cable reel 44. (When viewing the control unit 32 from the left side (i.e. from the plane occupied by left plate 36—as in the view shown in FIG. 4) any counterclockwise (or leftward) rotation of any wheel, sprocket or gear herein is defined as the "spooling direction" hereinafter and the clockwise (or rightward) rotation of any wheel is termed "unspooling direction.") It should be noted that although the disclosure describes the "spooling direction" as counterclockwise and vice versa, in other embodiments of the invention, the spooling direction may be clockwise and the unspooling direction may be counterclockwise and the directions described herein are exemplary only. Thus, one object of the invention is to employ a system that allows cable reel 44 to freely rotate in the spooling direction (thereby allowing a user to pull down the window), yet is unable to rotate in the opposite, unspooling direction (thereby preventing unintended unspooling of the cable reel). The above-described series of rings 50, 58, 68 are integral parts of a reel locking system as set forth below.

Figure 6:
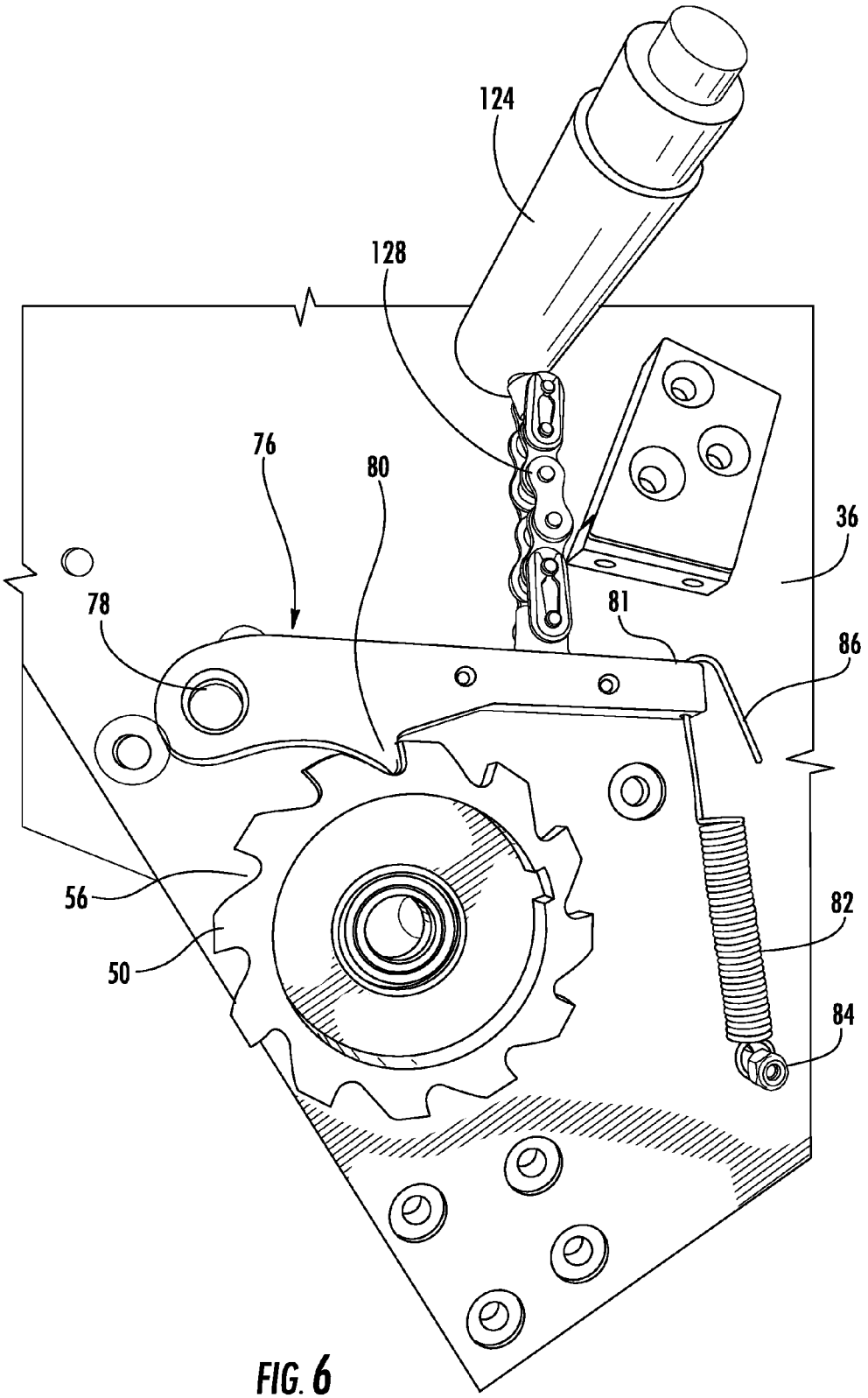
FIG. 6 is a partial cross sectional view of a reel locking system according to an embodiment of the invention.

FIG. 6 shows a reel locking system that prevents the cable reel 44 from rotating in the unspooling direction while the window is closed or is in the process of being closed. In one embodiment, as part of the locking system, a pivotable lever 76 or brake having a first end that is mounted on an axle, button 78 or similar pivot is mounted to left parallel plate 36. Such connection allows lever 76 to pivot upwardly (e.g. away from grooved wheel 50) and downwardly (e.g. toward grooved wheel 50). A finger-like projection 80 or similar lever segment protrudes from the bottom of lever 76. Projection 80 is sized and shaped to insert into respective grooves 56 on grooved wheel 50. The second end 81 of lever 76 is attached to a spring 82. Spring 82 has a first end 84 that is mounted to the inside surface of parallel plate 36 of the control unit 32. The second end of spring 82 has an attachment mechanism, such as a hook 86 for attaching to lever 76. Spring 82 provides constant bias against lever 76 so as to maintain projection 80 inserted in a groove 56 (as shown in FIG. 6). Projection 80 inserted in a groove 56, is a physical barrier to rotational movement of grooved wheel 50—thus locking grooved wheel 50 in place. (The term "lever" and "brake" are used interchangeably herein.) In a preferred embodiment, brake 76 is mounted on the inside wall of left plate 36, but alternative placements or arrangements are possible in different embodiments of the invention.

As stated, when the brake is engaged so that projection 80 of lever 76 is inserted into a groove 56 on wheel 50—grooved wheel 50 becomes locked in place and it is incapable of rotation. Wheel 50 directly surrounds and is attached to outer ring 60 of intermediate ring 58. As such, outer ring 60 also becomes locked in place when ring 50 is locked. Thus, only inner ring 62 of intermediate ring 58 is capable of rotation. That is, although outer ring 60 is locked in place—inner ring 62, which rotates in the opposite direction thereof is still capable of movement. Inner ring 62 directly surrounds and is attached to hub bushing 68. As such, hub bushing 68 and cable reel 44 attached thereto is capable of rotation in the same direction as inner ring 62—i.e. in the "spooling direction" (as labeled in FIG. 4)—but hub bushing 68 and cable reel 44 cannot rotate in the counter direction—i.e. in the unspooling direction (because hub bushing 68 is attached to inner ring 62, and inner ring can only rotate in one direction because of one-way gear 66). That is, when the brake is engaged, the outer ring 60 of the intermediate ring 58 becomes locked in place (by wheel 50), leaving only the inner ring 62 to rotate in a leftward or counterclockwise direction. The attached bushing hub 68 (and the attached cable reel 44) is, thus, also capable of counterclockwise rotation—but not clockwise rotation. As a result, when the brake 76 is engaged, the cable reel 44 is able to rotate in the spooling direction to reel cable in (in order to close the window), but it is not capable of rotating in the opposite direction (the "unspooling direction"). This ensures that cable reel does not accidentally or unintentionally unwind while a user is reeling the window closed or thereafter.

When brake 76 is released (i.e. projection 80 is withdrawn from groove 56), the cable reel 44 becomes free to rotate in the unspooling direction. That is, once the brake 76 is disengaged, the grooved wheel 50 becomes unlocked and free to rotate. As such, when hub bushing 68 rotates in the unspooling direction (see "unspooling arrow" in FIG. 4), hub bushing 68 causes inner ring 62 to rotate accordingly, which, in turn causes the intermediate ring 58 and the attached grooved wheel 50 to rotate in the unspooling direction as one unit. That is, once the grooved track is not locked in place, when axle 42 and cable reel 44 rotate in an unspooling direction, hub busing 68, intermediate ring 58 and grooved wheel 50 rotate as one unit. That is, hub bushing 68 rotates in the unspooling direction (see arrow in FIG. 4); thus, bushing 68 bears against inner ring 62 of intermediate ring 58. Because the unspooling direction is the opposite of inner ring's 62 one-way movement, inner ring 62 will bear against one-way gear 66—causing outer ring 60 and attached grooved wheel 50 to similarly rotate.

As will be explained in more detail below, disengaging the brake 76 causes the window to automatically open. That is, once cable reel 44 becomes free to move in the unspooling direction, the force exerted by the gas springs pushes the window open—causing the cable 48 to unspool from the spooling drum 46. To close the window, cable reel 44 is rotated in the spooling direction and as the cable length wraps around the drum of cable reel 44 it pulls in the window—overcoming the force of the gas springs.

Figure 7:
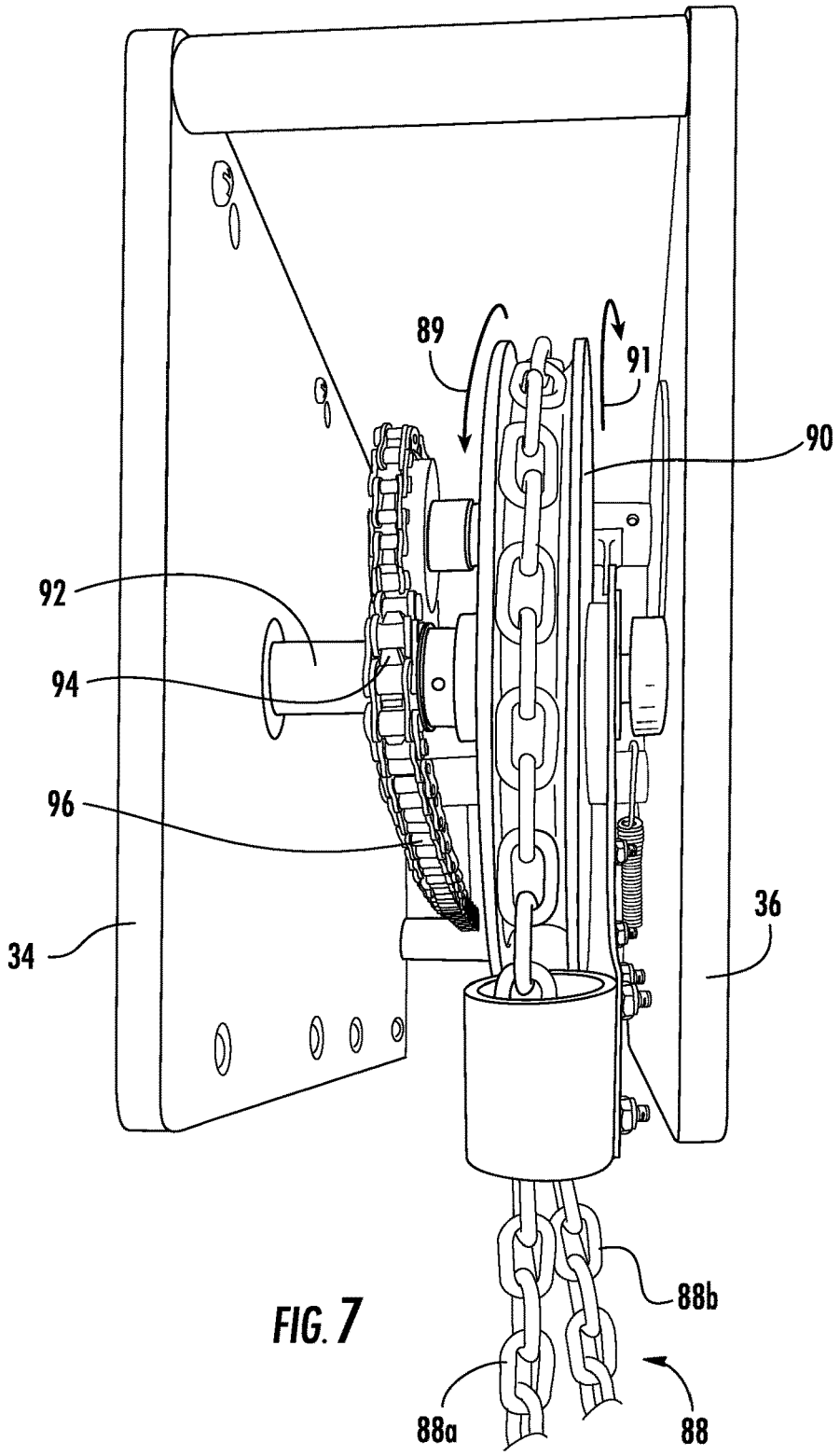
FIG. 7 is a rear view of a manual control unit according to an embodiment of the invention.

In an embodiment of the invention, a single chain or similar cable is used to, both, open and close the window 12 by pulling the chain in alternate directions. With reference to FIG. 7, which is a rear view of the control unit 32, a chain 88 is shown wrapped around a segment of pulley wheel 90. Pulley wheel 90 is mounted on and attached to rear axle 92. Respective ends of axle 92 are anchored in respective apertures in parallel plates 34, 36. A rear sprocket wheel 94 also is mounted around the shaft of axle 92 which retains a chain 96 (the sprocket is largely obscured by chain 96). As such, the rotation of pulley wheel 90 causes corresponding rotation of rear sprocket wheel 94. Chain 96 extends to the front of the control unit where it is pulled around a front sprocket wheel 98 (as shown in FIG. 2). It will be understood by those of ordinary skill in the art that pulley wheel 90 may be rotated by any of various mechanical means, such as by any of various chains or poles that are mechanically linked to the pulley wheel 90.

It should be noted that chain 88 may be pulled at two different locations to effect different movement of the pulley wheel 90. That is, front chain length 88*a* rotates the pulley in the spooling direction (direction of arrow 89—e.g. counterclockwise) and pulling down on rear chain length 88*b* causes pulley wheel 90 to rotate in the opposite direction (in the direction of arrow 91—e.g. clockwise). As such, rotation of the pulley wheel 90 effected by a user pulling chain 88, rotates the rear sprocket wheel 94 which also is attached to the rear axle 92. Rotation of rear sprocket wheel 94, in turn, causes rotation of the front sprocket wheel 98 because of the chain 96 running between front and back sprocket wheels. The rotation of front sprocket wheel 98 controls the opening and closing of the window as will be explained with reference to FIG. 3. It will be understood that although embodiments of the invention disclose mechanical linkages by way of sprocket wheels and associated chains—any of various mechanical linkages are possible in different embodiments of the invention, all of which are within the teaching of the invention. For example, mechanical linkages from pulley wheel 90 to cable reel 44 (and other linkages described herein) may be in the form of wheel gears, discs and/or belts.

FIG. 3 shows an enlarged view of the front axle 42 and the mechanical elements mounted thereon. As shown, front sprocket wheel 98 is mounted around the shaft of front axle 42 (front sprocket wheel 98 is shown without the chain for purposes of clarity). A disc 100 or similar plate is mounted to the left face of front sprocket wheel 98 and a similar disc 102 is mounted to the outside surface of right face plate 45*b* of cable reel 44. Respective discs 100, 102 are rounded protrusions having respective annular edges and faces 101, 103. An external surface 101 (also referred to as a "face") of disc 100 faces an external surface 103 (also referred to as a "face") of disc 102. The respective external surfaces 101, 103 are substantially parallel to one another and they each rotate with respective rotation of the sprocket wheel 98 and cable reel 44. Disc 100 has at least one nub or similar projection 104 extending from the external surface 101 thereof, and disc 102 has a similar nub or projection 106 extending from its external surface 103. Projection 104 has a flat surface 108 which is a contact surface and projection 106 has a similar flat contact surface 110. The discs 100 and 102 are oriented in a position in which respective contact surfaces 108, 110 face one another, and they are in such proximity where the respective contact surfaces 108, 110 share the same rotational trajectory. In one embodiment (best shown in FIGS. 9-12), three separate projections extending from face 101 contact three corresponding projections 106 on face 103.

When front sprocket wheel 98 is rotated in the spooling direction (direction of arrow 74*a*) attached disc 100 correspondingly moves in the spooling direction. Because contact surfaces 108, 110 face each other and they occupy the same rotational plane—contact surface 108 of disc 100 contacts contact surface 110 of disc 102 when disc 100 is rotated and it thereby moves disc 102 and, consequently, the attached cable reel 44 in the spooling direction. As such, in order to close the window, a user pulls down on front chain length 88*a* of chain 88 to cause rear sprocket wheel 94, and in turn, front sprocket wheel 98 to rotate in the spooling direction. Front sprocket wheel 98, in turn, causes cable reel 44 to rotate through mating discs 100, 102. As shown, a spring 105 contacts the right side of sprocket wheel 98 and biases sprocket wheel 98 toward cable reel 44 (i.e. leftward in the orientation shown). This maintains sprocket wheel 98 in contact with cable reel 44 during spooling of cable 48.

In order to close the window, a user pulls chain length 88*a* until sufficient length of cable 48 is wound around the cable reel 44 to pull the window closed. It should be noted that a user may incrementally close the window. As described, because the brake 76 is engaged during closing of the window—at any increment at which a user stops closing the window, it will be secured in place because unspooling is prevented by the brake.

Once the window is closed, the brake 76 must be disengaged in order to open the window (as described above). To that end, the same chain 88 is used to open the window through associated linkages described below.

With reference to FIG. 7, when rear chain length 88*b* is pulled downward, the associated pulley wheel 90 rotates in the direction counter to the spooling direction (in the direction of arrow 91). As such, rear sprocket wheel 94 and front sprocket wheel 98 similarly rotate in the unspooling direction. When front sprocket wheel 98 is rotated in the unspooling (in the direction of arrow 74*b* in FIG. 3), front sprocket 98 moves laterally in the direction away from cable reel 44 and toward right parallel plate 34. Such lateral movement is achieved as follows (with reference to FIGS. 8-12).

Figure 8:
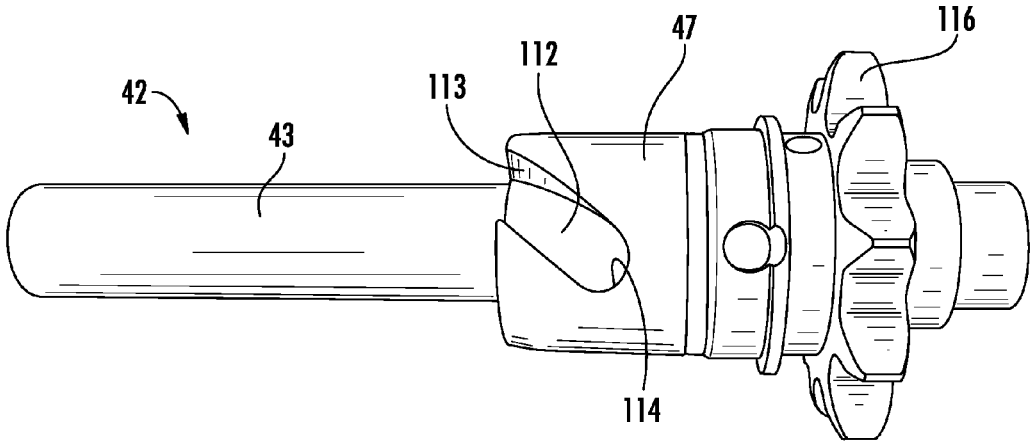
FIG. 8 is a side view of an axle for mounting a cable reel and other mechanical components according to an embodiment of the invention.

FIG. 8 shows a front view of axle 42. As shown axle 42 has a first shaft section 43 and a second section 47 of a larger circumference than that of shaft 43. Cable reel 44 is mounted on shaft section 43. Sprocket wheel 98 is mounted to disc 100—such that sprocket wheel 98 moves laterally when disc 100 moves laterally.

As shown, a helical groove 112 is notched into second section 47 of axle 42. Helical groove 112 is a curved notch-out in axle section 47 that opens just to the right (in the orientation shown) of shaft section 43. Disc 100 is mounted on shaft section 47 through specialized posts and riders that project into and ride in helical groove 112 to achieve lateral movement of disc 100 and thereby, sprocket wheel 98. It should be noted that rear sprocket wheel 94, secondary front sprocket wheel 116 and elevated sprocket wheel 120 are fixed around an axle or pivot such that they are each capable of rotation about an axis but they are not capable of movement in a lateral direction. Front sprocket wheel 98, however, is not fixed around axle 42, but rather it is attached to disc 100. Disc 100, is mounted around a shaft section of axle 42, but not affixed thereto. As such, disc 100 and sprocket wheel 98 can move laterally in space—in addition to rotating about an axis.

Figure 9:
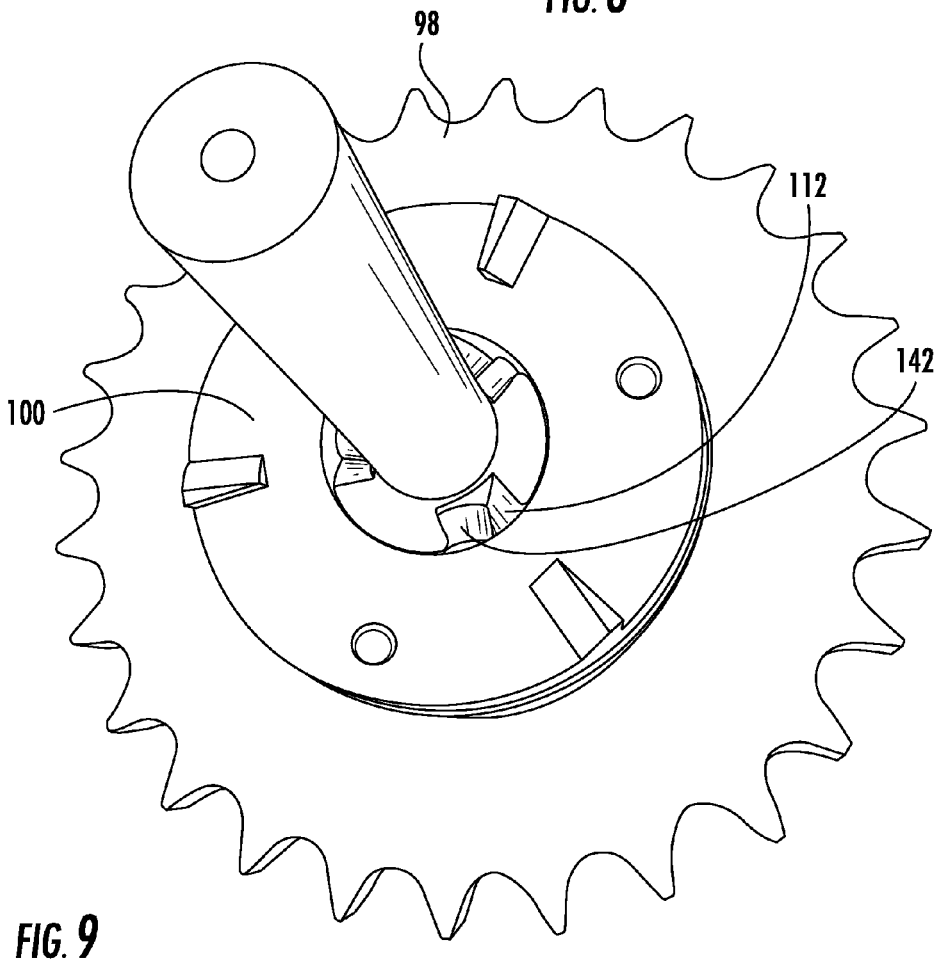
FIG. 9 is a left perspective side view of a sprocket wheel and associated disc with riders inserted into a helical groove provided on an axle according to an embodiment of the invention.

FIG. 9 shows a left side view of disc 100 attached to sprocket wheel 98 having pins or riders 142 projecting into helical groove 112. When sprocket wheel 98 is rotated in the unspooling direction, the riders 142 ride into the helical groove 112 causing the disc 100 and sprocket wheel 98 to move laterally away from cable reel 44. This causes disc 100 to separate from disc 102 such that respective projections 104 and 106 cannot contact one another—effectively disconnecting sprocket wheel 98 from cable reel 44. Sprocket wheel 98 moves laterally (through continued pulling of chain 88 in the direction of arrow 91 in FIG. 7) until the riders 142 reach the end wall 114 of the helical groove.

Figure 10:
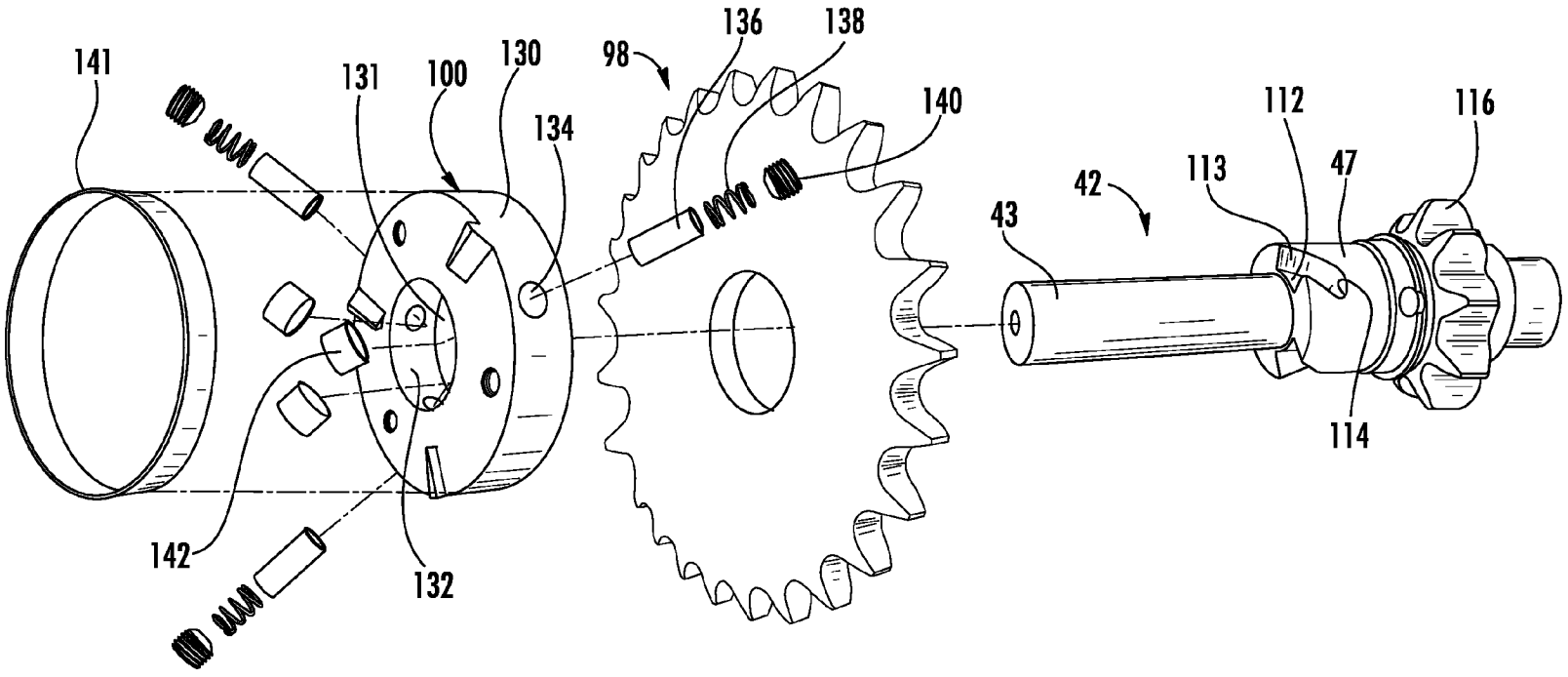
FIG. 10 is an exploded perspective view of a sprocket wheel and associated disc with pins inserting into a lumen thereof according to an embodiment of the invention.

FIG. 10 shows an exploded view of disc 100, attached sprocket wheel 98, and mechanical connections for supporting and maintaining posts and riders that project into the lumen of disc 100. As shown, disc 100 is substantially donut-shaped having an annular edge or outside wall 130 and a lumen 131 defined by inner wall 132. A plurality of holes are made in the outer wall 130 which extend to inner wall 132—thereby creating respective channels 134 from the outside wall 130 to the inside lumen 131 of disc 100. A top segment of channels 134 (i.e. segment closest to outer wall 130) is threaded so as to engage with a screw or such similar device.

As shown, a pin or post 136 is inserted into channel 134. Post 136 is maintained within channels 134, but a bottom segment thereof extends into lumen 131. A spring 138 is inserted atop of post 136, and a threaded screw 140 or similar cap is inserted atop of spring 138. Screw 140 is screwed into channel 134, and it bears against spring 138, which in turn bears against post 136. As such, post 136 remains biased into the lumen 131 of disc 100. Collars 142 (also referred to as "riders") are mounted to the terminal ends of posts 136 which extend into the lumen 131 of disc 100. Collars 142 are generally cylindrical elements that are oriented substantially orthogonally to posts 136. Collars 142, which surround and capture the terminal ends of posts 136 are sized and shaped to insert into helical grooves 112. Rounded outer walls of riders 142 are sized and shaped to ride along side walls 113 of helical grooves. In an embodiment of the invention, a band 141 is installed surrounding the annular edge of disc 100 to ensure that screws 140 remain in channels 134.

Figure 11:
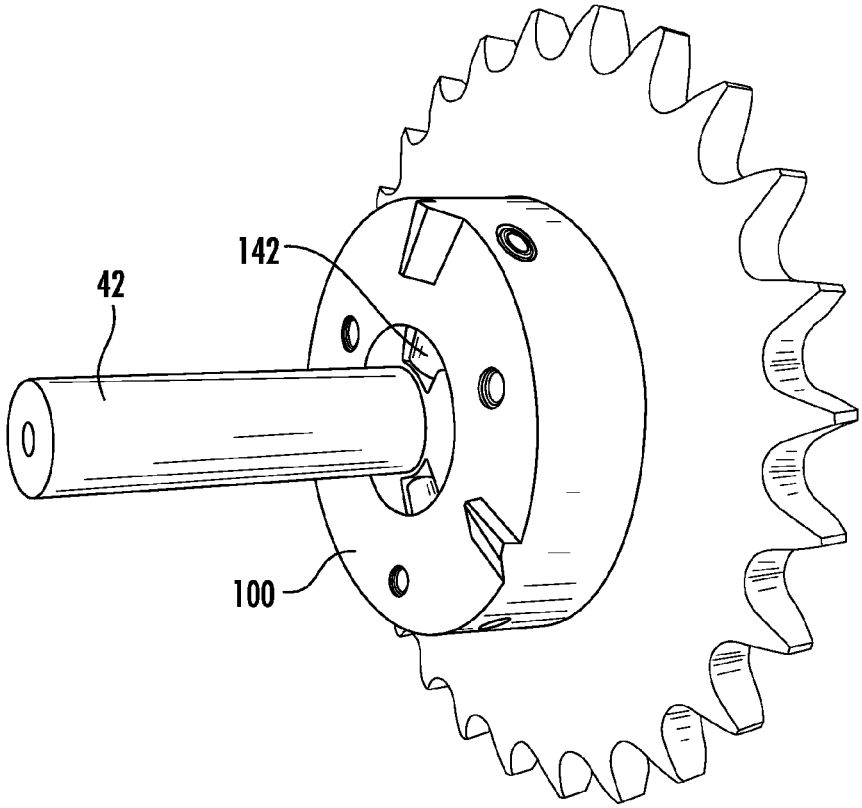
FIG. 11 is a side perspective view of a sprocket wheel and associated disc with riders inserted into the proximate opening of helical grooves according to an embodiment of the invention.

Disc 100 is mounted on shaft section 47 with riders 142 inserting into helical grooves 112. FIG. 11 shows a left side view of disc 100 with riders 142 positioned at a proximal position within helical grooves 112. At such proximal position, disc 100 is positioned in close enough proximity to disc 102 such that projections 104 extending therefrom contact corresponding projections 106 on disc 102 so that rotation of disc 100 (in the spooling direction) causes corresponding rotation of cable reel 44 (best shown in FIG. 3).

Figure 12:
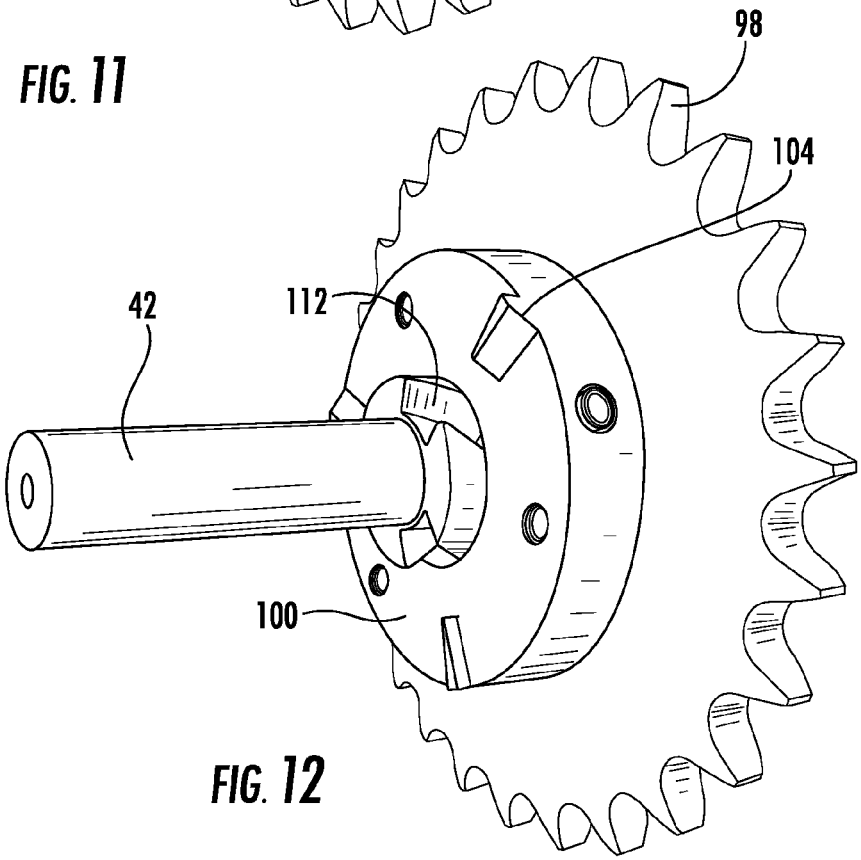
FIG. 12 is a side perspective view of a sprocket wheel and associated disc with riders inserted into a distal area of helical grooves according to an embodiment of the invention.

Conversely, rotation of sprocket wheel 98 in the unspooling direction (in direction 74*b* of FIG. 3), causes lateral movement of disc 100 and sprocket wheel 98 such that disc 100 of sprocket wheel 98 becomes separated from disc 102 of cable reel 44. That is, when sprocket wheel 98 is rotated in the unspooling direction, riders 142 ride into helical grooves 112 and continue riding along helical grooves 112 as sprocket wheel 98 continues rotating in the unspooling direction. FIG. 12 shows disc 100 of sprocket wheel 98 at a distal end of helical grooves 112. When the riders 142 reach the end wall 114 of the helical grooves 112, end wall 114 serves as a physical barrier preventing further movement of disc 100 and sprocket wheel 98 in the lateral direction. Continued rotational motion in the unspooling direction (through continued pulling of chain 88 in the direction of arrow 91 in FIG. 7) causes the riders 142 (supported by posts 136) to bear against the end wall 114 of helical grooves 112 causing axle 42 to rotate in the unspooling direction thereby unlocking cable reel 44 to unspool cable 48 as will be described below. After disc 100 reaches terminal end of helical groove 112, it may be rotated in a first direction to move back to the proximal end thereof. As such, disc 100 and sprocket wheel 98 are movable in two directions within a lateral plane, in addition to being rotatable about an axis.

Referring to FIGS. 3 and 8, a secondary front sprocket 116 also is mounted around the shaft of front axle 42. As such, when riders 142 reach the end wall 114 of helical grooves 112 and cause axle 42 to rotate in the unspooling direction (through continued pulling of chain 88 in the direction of arrow 91 in FIG. 7)—secondary front sprocket 116, thus, also rotates in the unspooling direction.

As shown in FIG. 2, secondary front sprocket wheel 116 retains a chain 118, which connects secondary front sprocket wheel 116 to an elevated sprocket wheel 120. Rotation in the unspooling direction of secondary front sprocket wheel 116 causes corresponding rotation of elevated sprocket wheel 120. Elevated sprocket wheel 120 surrounds an inner one-way gear or one-way clutch bearing 148. A cross bar 124 is attached to the center of the clutch bearing 148 and extends therefrom. The second end of cross bar 124 is attached to a chain 128. As shown, the first end of chain 128 is attached to cross bar 124 and the second end of chain 128 is attached to the second end of brake 76. As such when secondary front sprocket wheel 116 is rotated in the unspooling direction, attached elevated sprocket wheel 120 correspondingly rotates in the unspooling direction (in the direction of arrow 121). Attached cross bar 124 similarly rotates in the unspooling direction, and in turn, chain 128 slightly wraps around the shaft of cross bar 124 causing the chain to be somewhat raised (with respect to the floor). Second end of chain 128 thereby lifts brake 76 off of grooved wheel 50—freeing cable reel 44 to rotate in the unspooling direction. As described above, this causes the window to automatically open—as the force exerted by the gas springs 26 are no longer countered by the locked cable reel 44.

It should be noted that when secondary front sprocket 116 rotates in the spooling direction, then elevated sprocket wheel 120 correspondingly rotates in the spooling direction—but the attached cross bar 124 does not rotate on account of its attachment to one-way gear. However, when elevated sprocket wheel 120 rotates in the unspooling direction, cross bar 124 is correspondingly rotated to as described in more detail below.

Figure 13:
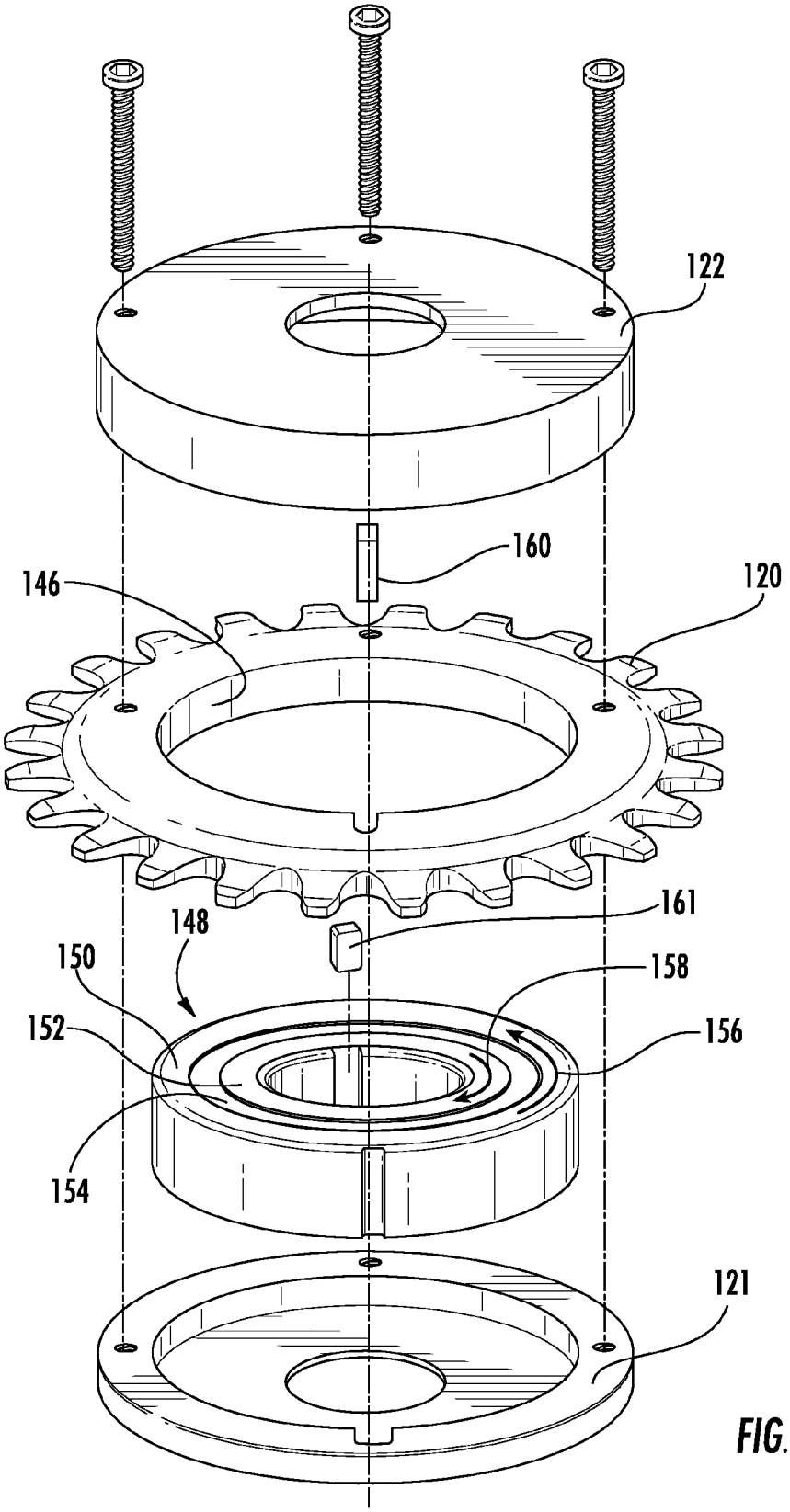
FIG. 13 is an exploded view of a wheel assembly having a one-way clutch bearing used to disengage a reel lock in an embodiment of the invention.

FIG. 13 shows an exploded view of elevated sprocket wheel 120 and associated one-way clutch bearing 148. As shown, sprocket wheel 120 has an internal ring 146 which surrounds a one-way gear 148. One-way gear 148 is a unitary ring that has three regions—an outer ring 150, an inner ring 152 and a middle region 154 between the inner and outer rings. Middle region 154 contains a one-way movement mechanism. As shown, outer ring 150 moves in one direction only (e.g. counterclockwise as depicted by arrow 158), but it cannot move in the opposite direction because of a ratchet gear or similar one-way track that is disposed between outer ring 150 and inner ring 152. Inner ring 152 rotates in a clockwise direction (i.e. in the direction of arrow 158) but it cannot rotate in the opposite direction. Internal ring 146 of sprocket wheel 120 is attached to one-way gear 148 by key 160. A bottom plate 121 and a cover plate 122 encapsulate the one-way bearing 148.

Figure 14:
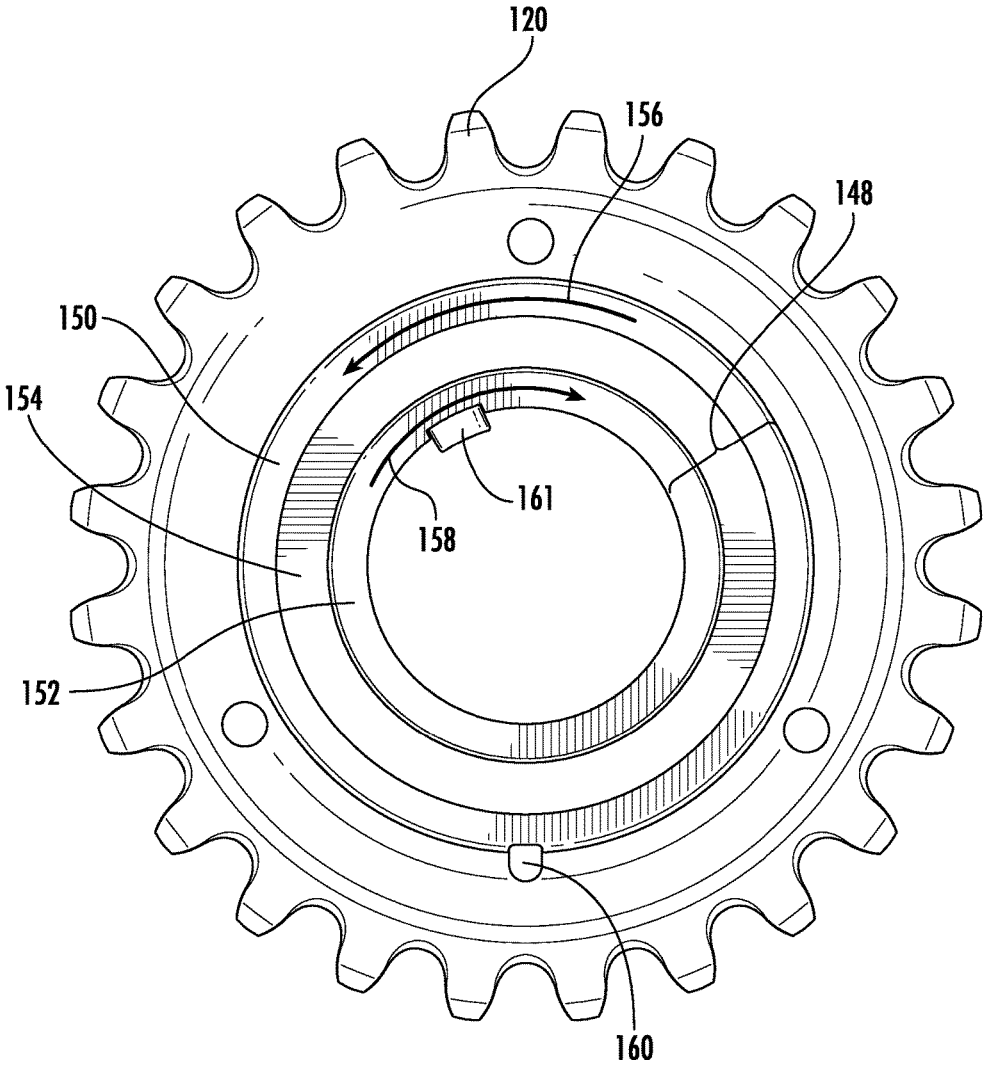
FIG. 14 is a top plan view of the wheel assembly of FIG. 13 with its cover removed according to an embodiment of the invention.

FIG. 14 shows a side view of elevated sprocket wheel 112 and one-way gear 148 attached to the inner circumference thereof. As shown, when sprocket wheel 112 rotates in the spooling direction (e.g. in the direction of arrow 156), outer ring 150 rotates in the same direction because its direction of movement is in the spooling direction; however, inner ring 152 does not rotate. Conversely, when sprocket wheel 112 rotates in the unspooling direction (e.g. in the direction of arrow 158), attached outer ring 150 bears against middle region 154 and middle region 154 bears against inner ring 152 thereby causing the same to rotate in its direction of movement (e.g. clockwise as depicted by arrow 158).

Figure 16:
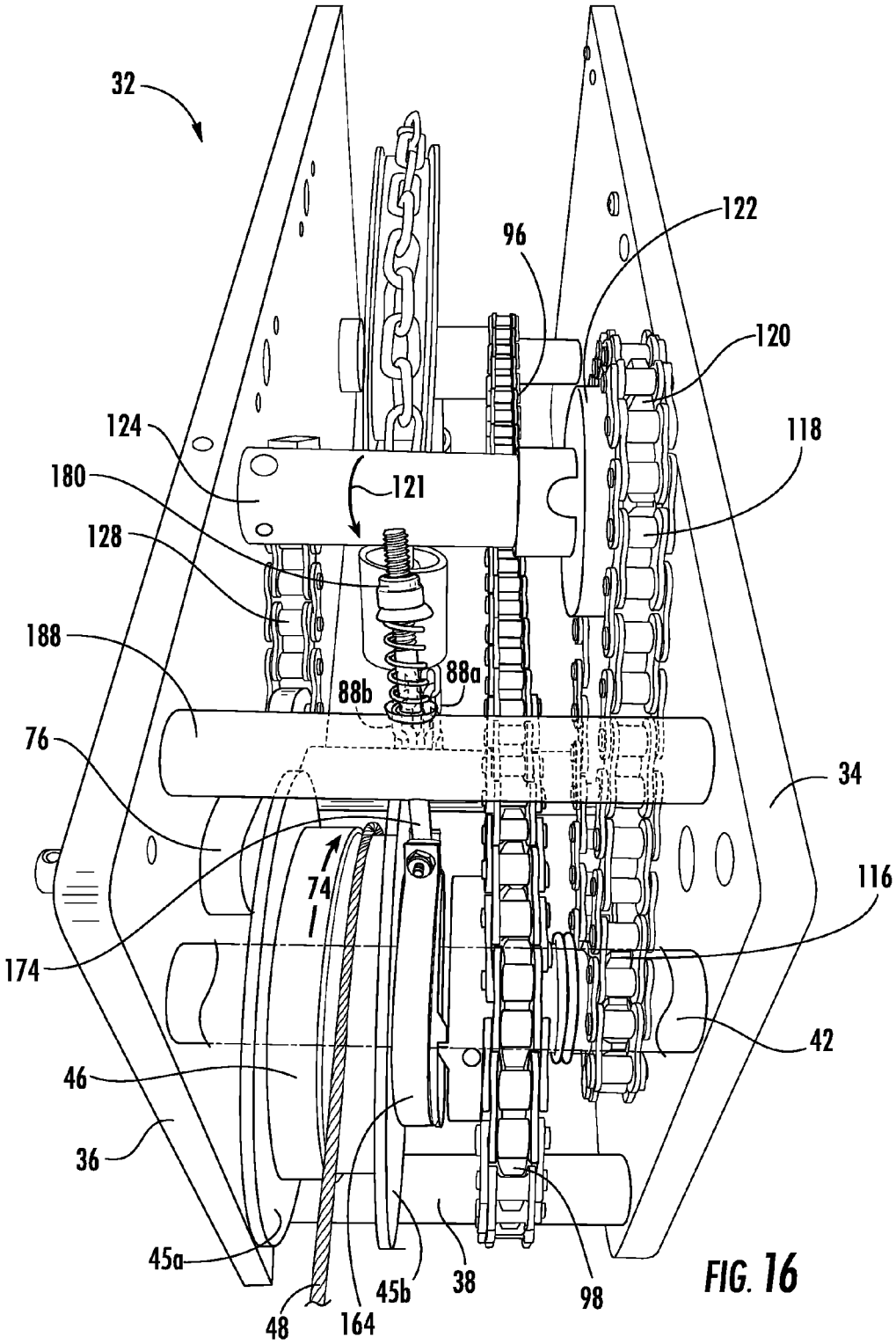
FIG. 16 is a top perspective view of a manual control unit having a damper system as shown in FIG. 15 installed thereon according to an embodiment of the invention.

The shaft of cross bar 124 inserts into the lumen of inner ring 152 and is attached thereto by way of key 161 (cross bar 124 not shown in FIGS. 14 and 16). As such, rotation of inner ring 152 effectuates corresponding rotation of cross bar 124. Thus, as described, in order to open the window, a user will pull on chain length 88*b* ultimately achieve unspooling rotation of elevated sprocket wheel 112, inner ring 152 and attached cross bar 124. As described, cross bar 124 rotates so as to raise chain 128 and thereby free brake 76 (overcoming spring 82 shown in FIG. 6). Once brake 76 is removed from grooved wheel 50—there is no longer a lock on cable reel 44. Thus, the gas springs 26 force the window upward and open.

Gas springs 26 apply a strong biasing force against the window 12, such that when counterforce is removed—the window is rapidly forced upwardly with a great deal of force and speed. In an embodiment of the invention, a damper system is employed to reduce the speed at which the window rises.

Figure 15:
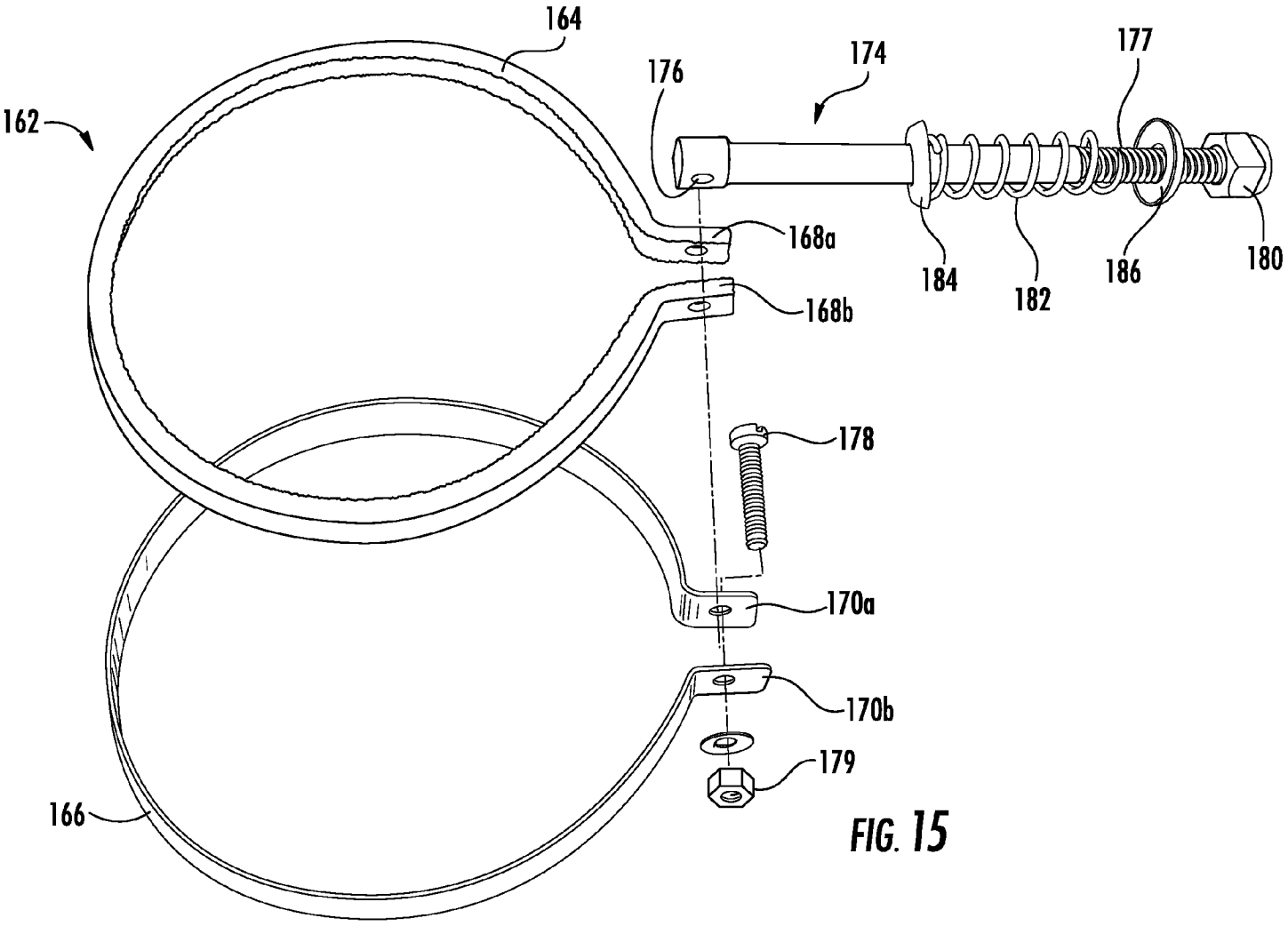
FIG. 15 is an exploded view of a damper system according to an embodiment of the invention.

FIG. 15 shows an exploded view of a damper system 162 according to an embodiment of the invention. The damper system 162 is a ring-shaped band that surrounds disc 102 attached to cable reel 44. The band applies friction to disc 102 to slow the speed at which cable reel 44 unspools—thereby slowing the speed of the opening window 12.

Damper 162 is a loop having an inner belt 164 that is made of leather, Teflon, plastic or such similar soft and flexible, yet resilient material and an outer band 166 that surrounds belt 164. Outer band 166 is a thin strip, preferably made of a metallic material such as aluminum, stainless steel or the like and is sized and shaped to tightly conform to the outside perimeter of belt 164. Terminal ends of outer band 166 and inner belt 164 flange outwardly forming flanged ends 168*a*, 168*b* and 170*a*, 170*b* (of belt 164 and band 166, respectively). Each flanged end has a hole 172 or similar aperture.

Outer band 166 is placed around belt 164 such that flanged ends and holes in flanged ends are aligned. A bolt 174 having a hole 176 at its terminal end is used to attach damper 164 to control unit 32. As shown, terminal end of bolt 174 is positioned between flanged ends 168*a*, 168*b* of belt 164 with hole 176 aligning with holes on flanged ends. A screw 178 is inserted to maintain the damper in a closed loop and to attach the same to bolt 174. Screw is inserted through the hole in flanged end 170*a* of band 166, through the hole in flanged end 168*a* of belt 164, through the hole 176 of bolt 174, through the flanged end 168*b* of belt 164, and finally through the hole on flanged end 170*b* of band 166. A nut 179 or similar fastener is attached or screwed on to terminal end of screw 178. As stated, screw 178, both, fastens the loop (created by band 166 and belt 164) closed and also attaches the loop to bolt 174.

Bolt 174 has a threaded end 177 that mates with a nut 180 or similar fastener. A spring 182 is inserted around a longitudinal section of bolt 174. As shown, a bottom cap 184 is inserted onto bolt 174 which contacts the bottom of spring 182 and prevents spring 182 from moving past cap 184. An upper cap 186 is inserted just above of spring 182 which contacts the top of spring 182 when nut 180 is tightened.

FIG. 16 shows damper system 164 attached to control unit 32 according to an embodiment of the invention. As shown, the loop of damper unit 164 surrounds disc 102 of pulley reel 44 with inner belt 164 contacting the annular edge of disc 102. Bolt 174 is inserted through a channel in cross bar 188 with terminal threaded end 177 projecting upwardly from cross bar 188.

In use, damper 164 is tightened and/or adjusted in the following manner. Nut 180 is rotated so that it moves down the shaft of bolt 174 until it contacts upper cap 186. Upper cap 186 bears against spring 182, thereby causing spring 182 to exert tension on cap 186 and nut 180. Such tension against cap 186 and nut 180 causes bolt 174 to be incrementally moved upward. Such incremental movement of bolt 174 causes a tensioning force on damper 162. Continued rotation of nut 180 causes bolt 174 keep traveling upwardly thereby applying greater tensioning force on attached damper 162. A user or factory can set the bolt to a specified level of tension to ensure controlled opening of window 12.

Another aspect of the invention is an improved apparatus and method for reeling cable or similar cord. Cable often spools around a cable reel in a haphazard fashion, possibly causing tangling or snarling of the cable. An embodiment of the invention prevents such tangling by employing a novel cable reel drum that is designed to guide cable to spool in a controlled and organized manner.

Figure 17:
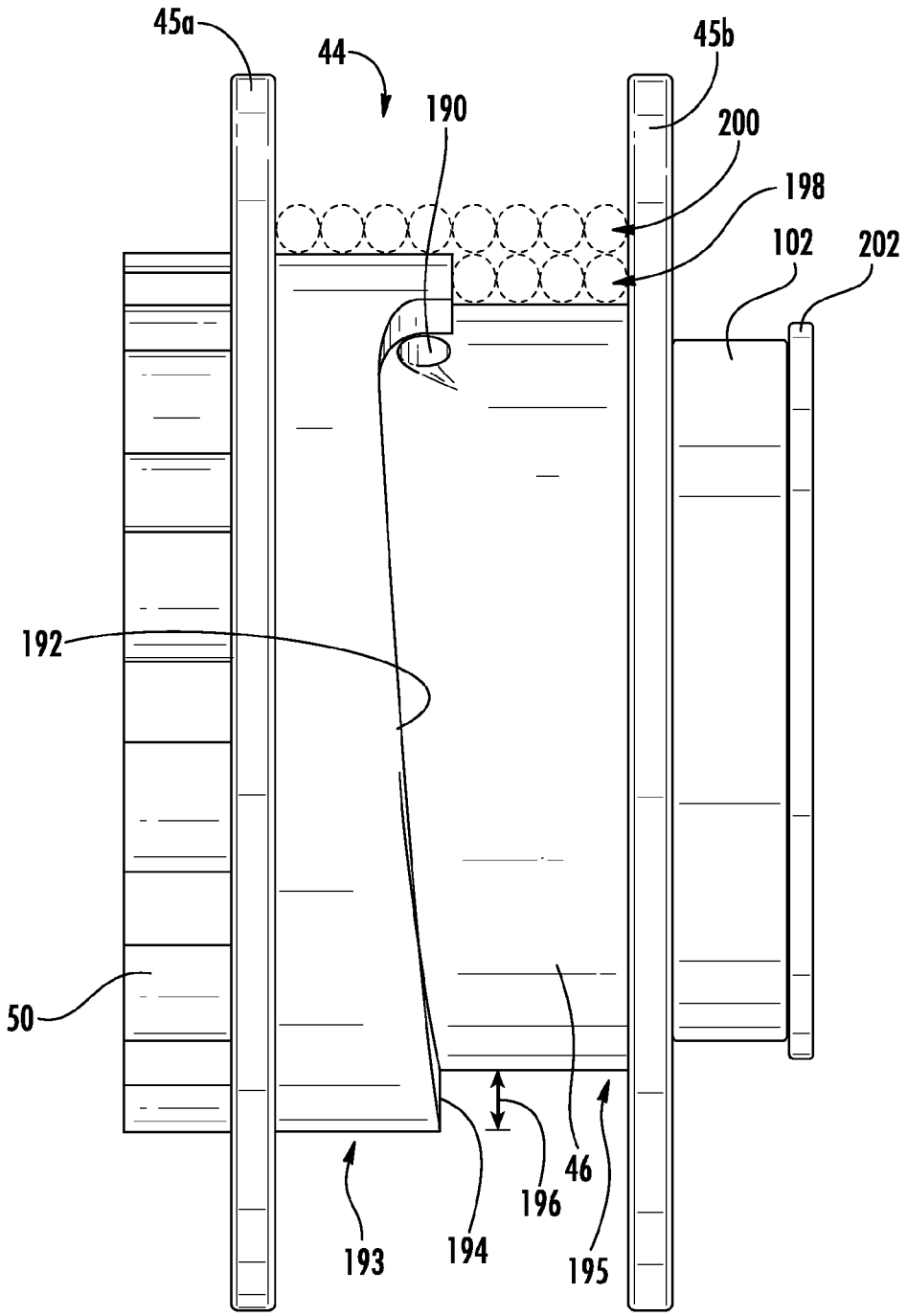
FIG. 17 is a front view of a cable reel having a grooved inner track according to an embodiment of the invention.

FIG. 17 shows an embodiment of a novel cable reel 44 according to an embodiment of the invention. FIG. 17 shows a cable reel 44 with an aperture 190 from which a cable emanates (cable not shown). A curved wall or ramp 192 begins at the point at which cable is attached to reel 44. Ramp 192 gradually slopes toward one side of the reel (to the right in the orientation shown in FIG. 17). That is, the distance between wall of ramp 192 and left side face plate 45*a* increases as ramp 192 extends around the drum 46 of pulley wheel 44. Ramp 192 guides cable that is being spooled to move rightward (in the orientation shown) as it winds around the drum 46. Ramp 192, thus, divides drum 46 into two sections: an upper section 193 and a lower section 195. A step 194 down, separates upper section 193 from lower section 195. Step 194 extends roughly 90° down from upper section 193. Preferably the height 196 of step 194 is substantially the same as the diameter of cable that is to be reeled. As such, when cable is reeled using the inventive cable reel 44, cable is urged to the right by ramp 192 and it continues spooling into lower drum section 195 until it reaches right face plate 45*b*.

FIG. 17 shows a schematic cross-sectional view of a first row of cable 198 wound around lower drum section 195. Once cable reaches side face plate 45*b*, it will begin spooling in the other direction (e.g. to the left). Because, the height of step 194 is substantially the same as the cable diameter, once a first layer 198 of cable is laid down between step 194 and face plate 45*b*, there is a continues layer upon which a second layer of cable may wind. FIG. 17 schematically shows a cross-sectional view of a second layer 200 of cable wound atop a substantially continuous surface formed by first layer 198 and second upper section 193. This process continues until all cable is wound around cable reel 44.

Also shown in FIG. 17 is a lip 202 that extends around and orthogonally to the annular edge of disc 102. The height of lip 202 is substantially equal to or somewhat greater than the combined thickness of band 166 and belt 164 of damper system 162. Lip 202, thus, acts as a physical barrier preventing lateral movement or slippage of damper system 162.

While the present invention has been described with respect to an exemplary embodiments, it will be appreciated that many modifications and variations may be made without departing from the true spirit and scope of the invention. It is, therefore, the intent of the present application to cover all such modifications and variations which fall within the true spirit and scope of the invention.

What is claimed is:

1. A hinged panel system, comprising:

a casing frame;

a panel attached to the casing frame with a hinge;

an arm configured to exert a force on the panel to bias the panel upward with respect to the casing frame;

a control unit mounted to the casing frame;

the control unit comprising:

a first axle having a pulley wheel mounted thereon, the first axle further comprising a first sprocket wheel;

a second axle having a cable reel mounted thereon, the cable reel having a cable extending therefrom, wherein a first segment of the cable is connected to the panel;

the second axle further comprising a second sprocket wheel; the first sprocket wheel mechanically linked to the second sprocket wheel, the second sprocket wheel configured to rotate about an axis of the second sprocket wheel and to move laterally from a first lateral position to a second lateral position, wherein in the first lateral position, the second sprocket wheel contacts the cable reel, and in the second lateral position, the second sprocket wheel is disengaged from the cable reel;

a spring mounted on the second axle and configured to bias the second sprocket wheel toward the first lateral position;

a first chain engaged with the pulley wheel, the chain configured to rotate the pulley wheel in a first direction and a second direction;

a cable reel lock linked to the cable reel, the cable reel lock configured to selectively allow rotation of the cable reel in the first direction and prevent rotation of the cable reel in the second direction, the cable reel lock comprising a wheel having a plurality of grooves and a lever having a segment that is sized and shaped to fit into any one of the plurality of grooves, whereby when the segment of the lever is inserted into one of the grooves, the cable reel is free to rotate only in the first direction;

a second chain, the second chain comprising a linear chain segment having a first end and a second end, the first end being connected to the lever, the second chain being mechanically linked to the second sprocket wheel;

whereby when the pulley wheel is rotated in the first direction, the first sprocket wheel rotates the second sprocket wheel in the first direction, and the second sprocket wheel rotates the cable reel in the first direction, whereby when the cable reel rotates in the first direction, a second segment of the cable connected to the cable reel is spooled around a spooling drum of the cable reel;

whereby when the pulley wheel is rotated in the second direction, the first sprocket wheel rotates the second sprocket wheel in the second direction and rotation of the second sprocket wheel in the second direction causes the second sprocket wheel to overcome the spring bias of the spring and move into the second lateral position, whereby the second sprocket wheel rotating in the second direction causes mechanical linkages to pull the second chain and remove the segment of the lever from the grooved wheel.

2. The system of claim 1, further comprising a third sprocket wheel, the third sprocket wheel mounted on the second axle.

3. The system of claim 2, further comprising:

a fourth sprocket wheel;

a one-way bearing disposed between the fourth sprocket wheel and a cross bar; and the cross bar having a first end that is retained by the one-way bearing and a second end that is attached to the second end of the second chain.

4. The system of claim 3, whereby the third sprocket wheel is configured to rotate the fourth sprocket wheel in the second direction and the fourth sprocket wheel is configured to rotate the cross bar in the second direction.

5. The system of claim 4, whereby said second axle comprises a first shaft section having a first diameter and a second shaft section having a second diameter, whereby said second diameter is greater than said first diameter, said second shaft section comprising helical grooves.

6. The system of claim 5, further comprising a chain disposed between the first sprocket wheel on the first axle and the second sprocket wheel on the second axle, whereby when the pulley wheel is rotated in the first direction, said first sprocket wheel, said second sprocket wheel, and said third sprocket wheel each rotate in said first direction.

7. The system of claim 6, whereby the second sprocket wheel rotating in the first direction contacts the cable reel and causes the cable reel and the second axle to rotate in the first direction.

8. The system of claim 7, whereby the second sprocket wheel comprises a disc, and the cable reel comprises a disc, the disc of the second sprocket wheel and the disc of the cable reel are facing one another and are substantially parallel to each other, the disc of the second sprocket wheel comprising at least one projection projecting from a face thereof, the disc of the cable reel comprising at least one projection projecting from a face thereof, whereby when the second sprocket wheel is rotated in the first direction, the at least one projection of the disc of the second sprocket wheel contacts the at least one projection of the disc of the cable reel thereby rotating the cable reel in the first direction.

9. The system of claim 8, whereby the disc of the second sprocket wheel comprises an outside wall and an inside wall, said inside wall defining a lumen, whereby holes extend from said outside wall to the lumen, whereby posts are disposed in the holes.

10. The system of claim 9, further comprising collars having rounded exterior walls surrounding terminal ends of the posts.

11. The system of claim 10, whereby the collars project into the helical grooves in the second shaft section, and rotation of the second sprocket wheel in the second direction causes the collars to travel from a proximate position in the helical grooves to a distal position in the helical grooves which causes the second sprocket wheel to move from the first lateral position to the second lateral position.

12. The system of claim 11, whereby when the second sprocket wheel moves from the first lateral position to the second lateral position, the disc of the second sprocket wheel separates from the disc of the cable reel and the at least one projection projecting from the disc of the second sprocket wheel does not contact the at least one projection of the disc of the cable reel.

13. The system of claim 11, whereby when the second sprocket wheel rotates in the second direction and the collars are positioned in the distal position in the helical grooves, the collars bear against end walls of the helical grooves and cause the second axle and the third sprocket wheel to rotate in the second direction.

14. The system of claim 13, whereby the one-way bearing comprises an outer ring, a one-way movement track and an inner ring, whereby the cross bar is attached to the inner ring.

15. The system of claim 14, further comprising a chain disposed between the third sprocket wheel on the second axle and the fourth sprocket wheel such that rotation of the third sprocket wheel in the first direction causes the fourth sprocket wheel to rotate in the first direction and rotation of the third sprocket wheel in the second direction causes the fourth sprocket wheel to rotate in the second direction.

16. The system of claim 15, whereby rotation of the fourth sprocket wheel in the first direction rotates the outer ring of the one-way bearing in the first direction, and rotation of the fourth sprocket wheel in the second direction rotates the inner ring in the second direction, whereby when the inner ring rotates in the second direction, the cross bar correspondingly rotates in the second direction.

17. The system of claim 16, whereby said cable reel comprises a first side plate and a second side plate, the first side plate comprising a hub bushing and a second one-way clutch bearing comprising an inner ring, a middle annular region, and an outer ring surrounding the hub bushing, the inner ring of the second one-way clutch bearing attached to the hub bushing.

18. The system of claim 17, whereby the grooved wheel is attached to the second one-way clutch bearing, the grooved wheel having an annular internal circumference and an external circumference, the external circumference forming the plurality of grooves, whereby the annular internal circumference is connected to the outer ring of the second one-way clutch bearing.

19. The system of claim 18, whereby when the segment of the lever is inserted into one of the plurality of the grooves, the lever blocks rotational movement of the grooved wheel in the second direction and the outer ring of the second one-way clutch bearing is blocked from rotational movement in the second direction and the inner ring of the second one-way clutch bearing remains rotatable in the first direction.

* * * * *